US006250885B1

(12) United States Patent
Gajewski

(10) Patent No.: US 6,250,885 B1
(45) **Date of Patent: *Jun. 26, 2001**

(54) BLADE MOUNTING ASSEMBLY FOR A CEILING FAN

(75) Inventor: Mark Gajewski, Culver, CA (US)

(73) Assignee: Minka Lighting, Inc., Corona, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/338,405

(22) Filed: Jun. 22, 1999

Related U.S. Application Data

(62) Division of application No. 09/046,956, filed on Mar. 24, 1998, now Pat. No. 5,951,253.
(60) Provisional application No. 60/041,577, filed on Mar. 24, 1997.

(51) Int. Cl.[7] ..... F01D 5/30
(52) U.S. Cl. ..... 416/214 R; 416/220 A
(58) Field of Search ..... 416/5, 204 R, 416/205, 207, 210 R, 214 R, 220 A; 403/337

(56) References Cited

U.S. PATENT DOCUMENTS

| | | | | |
|---|---|---|---|---|
| Re. 34,147 | | 12/1992 | Rezek | 416/5 |
| 332,821 | | 12/1885 | Murray, Jr. . | |
| 477,614 | | 6/1892 | Tuerk, Jr. . | |
| 2,084,862 | * | 6/1937 | Moser | 403/337 |
| 2,967,040 | | 1/1961 | Picha | 248/343 |
| 4,009,970 | | 3/1977 | Forth, Jr. | 416/134 R |
| 4,053,259 | | 10/1977 | Bianchi | 416/208 |
| 4,073,598 | | 2/1978 | Mizutani et al. | 416/5 |
| 4,531,179 | | 7/1985 | Baker | 362/371 |
| 4,538,973 | | 9/1985 | Angott et al. | 417/572 |
| 4,884,947 | | 12/1989 | Rezek | 416/5 |
| 5,222,864 | * | 6/1993 | Pearce | 416/5 |
| 5,292,228 | | 3/1994 | Dye | 416/5 |
| 5,421,701 | | 6/1995 | Funston | 415/5 |
| 5,944,487 | | 8/1999 | Pearce | 416/244 R |
| 5,951,253 | | 9/1999 | Gajewski | 416/214 R |

OTHER PUBLICATIONS

Mark Gajewski; U.S. application No. 09/047,024, filed Mar. 24, 1998.

Mark Gajewski; U.S. application No. 09/047,257, filed Mar. 24, 1998.

Mark Gajewski; U.S. application No. 09/047,257, filed Mar. 24, 1997.

* cited by examiner

*Primary Examiner*—Edward K. Look
*Assistant Examiner*—James M McAleenan
(74) *Attorney, Agent, or Firm*—Jenkens &Gilchrist, P.C.

(57) ABSTRACT

A blade mounting assembly for a ceiling fan has a plurality of blades and a ceiling fan motor with a motor body that rotates about a motor shaft. A fan housing/blade mounting assembly secures the fan blades to the motor body. The blade mounting assembly has a first ring secured to the motor body, sets of first spacers disposed on the first ring, each set of first spacers corresponding to a different fan blade, a second ring, and sets of second spacers, each set of second spacers corresponding to a different fan blade. The second ring is secured to the first ring such that each of the blades are disposed between the corresponding sets of spacers. The sets of first spacers each comprise a longer first spacer and a shorter first spacer. The sets of second spacers each comprise a longer second spacer and a shorter second spacer. Each of the fan blades are disposed between the corresponding shorter first spacer and longer second spacer, and between the corresponding longer first spacer and shorter second spacer.

13 Claims, 24 Drawing Sheets

BLADE MOUNTING ASSEMBLY FOR A CEILING FAN

RELATED APPLICATION

The present application is a divisional of U.S. application Ser. No. 09/046,956, filed on Mar. 24, 1998, now issued as U.S. Pat. No. 5,951,253 on Sep. 14, 1999, which is a continuation of U.S. Provisional Application Ser. No. 60/041,577, filed Mar. 24, 1997, which is incorporated in its entirety herein by specific reference thereto. The present application has a common specification with and is related to U.S. application Ser. No. 09/047,257, filed Mar. 24, 1998, currently pending; and U.S. Ser. No. 09/047,024, filed Mar. 24, 1998, currently pending.

BACKGROUND

The present invention relates to ceiling fans.

A typical ceiling fan will include a downrod suspended from the ceiling, a motor having a motor shaft connected to a lower portion of the downrod and a motor body which rotates about the motor shaft, a motor housing secured to either the motor shaft or the downrod assembly which is stationary and surrounds the motor, blade mounting irons which connect to the motor body and extend out of an opening of the motor housing, and blades attached to the blade irons below the motor housing. The use of a separate stationary motor housing forces the blade irons of a typical ceiling fan to extend out of an opening in the housing, which increases the vertical dimension of the portion of the ceiling fan suspended below the downrod. Therefore, there is a need for methods and apparatuses of mounting the fan blades to the motor body which will reduce the vertical dimension of the ceiling fan below the downrod assembly.

Because the motor housing of a typical ceiling fan encloses the motor, the motor housing must have various openings to allow the escape of heat from the motor. However, the openings in the motor housing complicate the design of the motor housing and may limit the escape of heat from the motor because of the limited availability of the apertures in the motor housing. Therefore, there is a need for motor housing that will provide the motor with better heat transfer than a typical motor housing.

Also, electrical wiring for operating a typical ceiling fan passes through a single downrod to the motor. The single downrod screws onto the motor shaft to secure the motor there below. However, the size of the wiring will limit the minimum size of the downrod. Therefore, there is a need for alternative downrods that can have a reduced diameter, and a method of securing the motor to the alternative downrods.

SUMMARY

In one embodiment the present invention is a blade mounting assembly for a ceiling fan having a plurality of blades and a ceiling fan motor with a motor body that rotates about a motor shaft, the blade mounting assembly including: a first ring secured to said motor body; a plurality of sets of first spacers disposed on the first ring, each of the sets of first spacers corresponding to a different one of the plurality of blades; a second ring having a plurality of sets of second spacers disposed therein, each of the sets of second spacers corresponding to a different one of the plurality of blades; and wherein the second ring is secured to the first ring such that each of the plurality of blades are disposed between the corresponding set of first spacers and the corresponding set of second spacers.

In another embodiment, the present is directed to a downrod assembly for a ceiling fan suspended from a ceiling bracket and having a motor, the downrod assembly including: an upper downrod bracket plate pivotally connected to the ceiling bracket; a plurality of downrods connected to the upper downrod bracket; a lower downrod bracket connected to the motor.

In yet another embodiment, the present invention is directed to a hub mounting system for a ceiling fan having a motor body that rotates around a motor shaft, the hub mounting system including: a platter mounting plate secured to the motor shafts the platter mounting plate having a plurality of mounting slots with a larger initial opening and a smaller sliding opening the smaller sliding openings extending in the same circumferential direction; a hub assembly having a plurality of mounting studs, each one of the plurality of mounting studs corresponding to a different one of the mounting slots in said platter mounting plate; wherein said studs have an upper head that is smaller than the larger initial opening of the mounting slots in the mounting plate and larger than the smaller sliding openings; and wherein the studs further include an inner shaft portion below the upper head that is smaller than the smaller slider openings of the mounting slots in the platter mounting plate.

BRIEF DESCRIPTION OF THE DRAWINGS

These and other features, aspects, and advantages of the present invention will become better understood with regard to the following description, appended claims, and accompanying drawings where:

DETAILED DESCRIPTION

Figure 1:
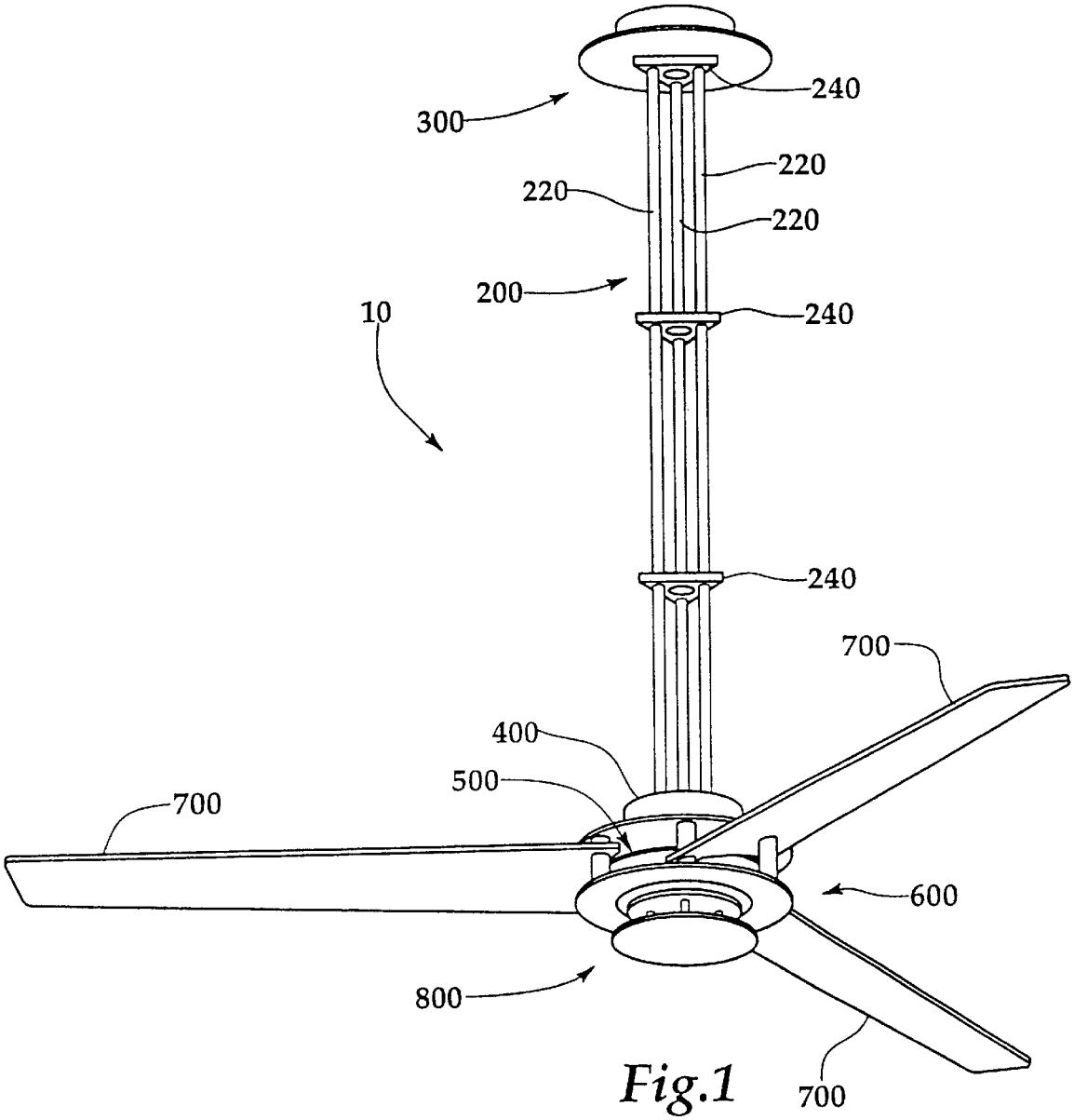
FIG. 1 shows a perspective view of one embodiment of the present invention, illustrated as a ceiling fan.
Figure 2:
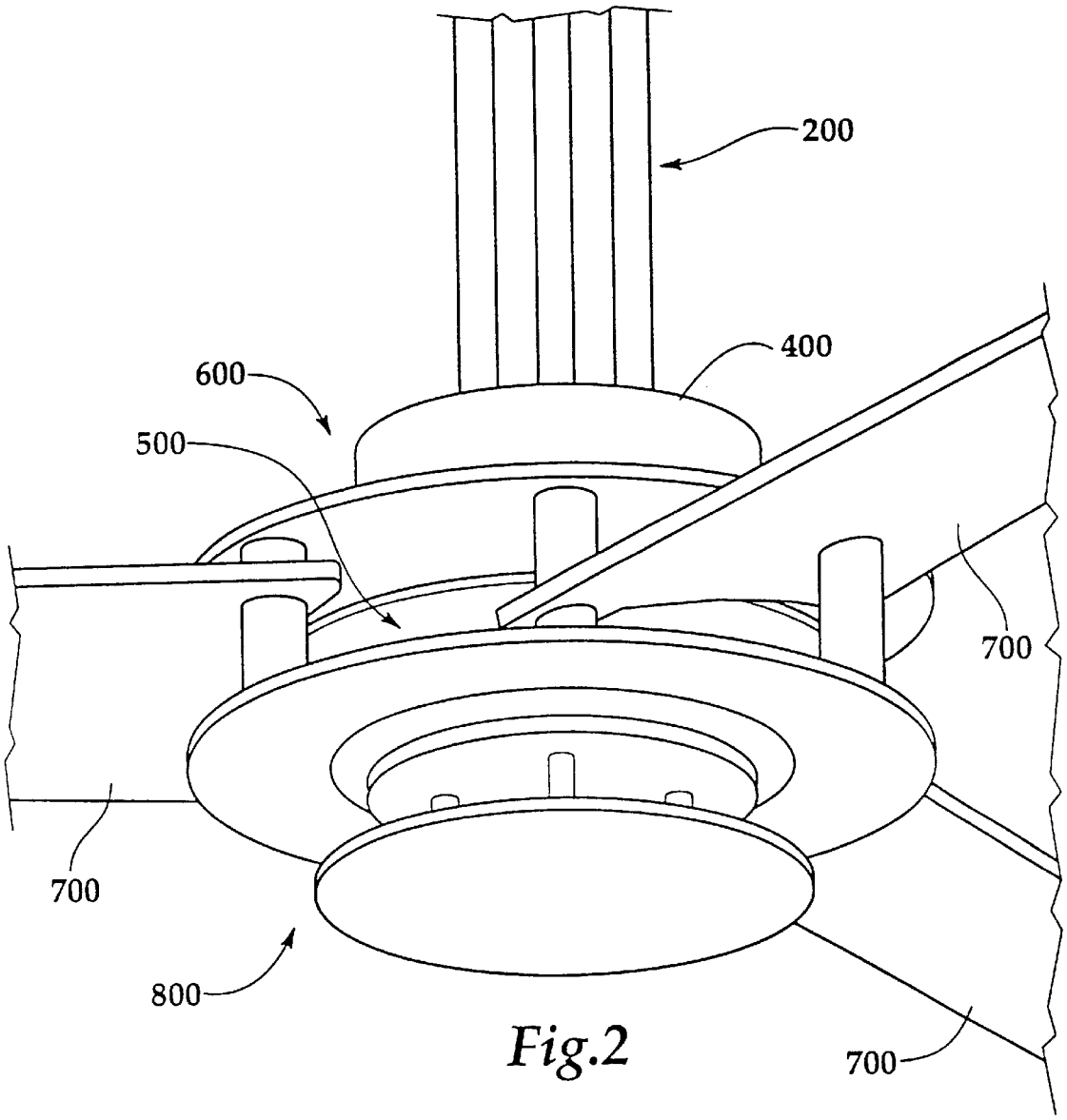
FIG. 2 shows a perspective view of the motor and motor housing from the ceiling fan in FIG. 1.
Figure 3A:
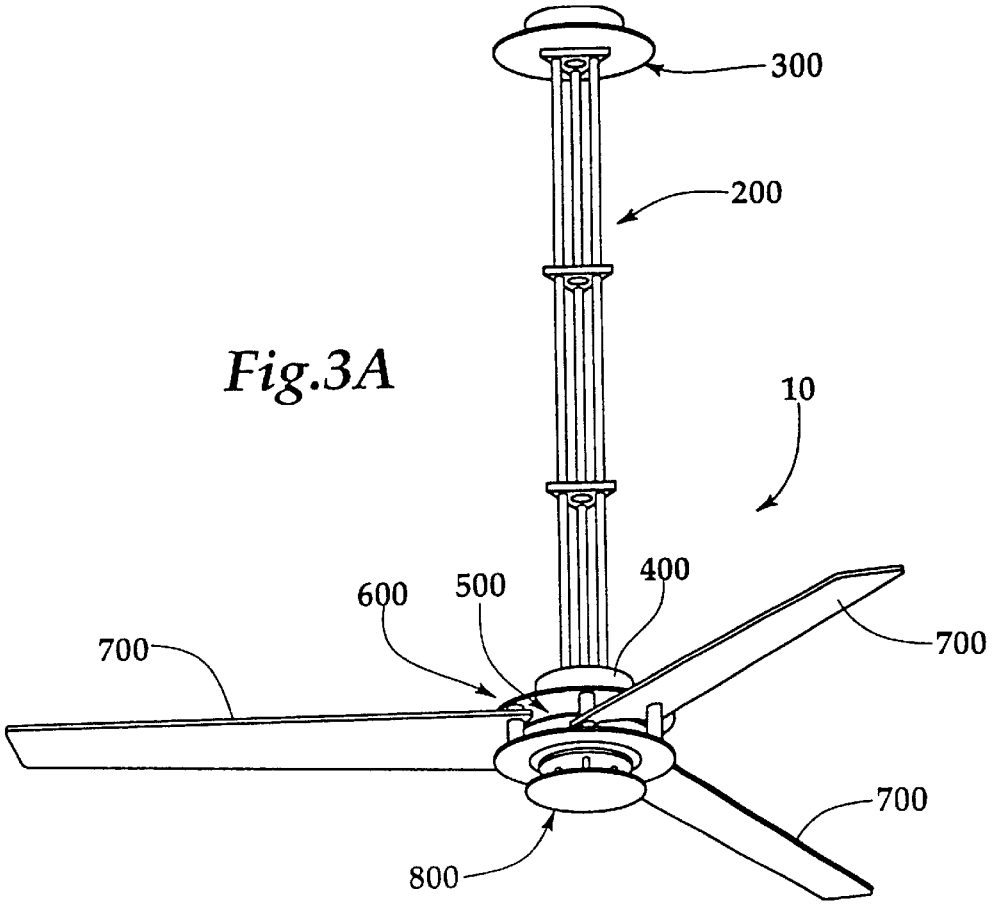
FIGS. 3A–D illustrate perspective views of the ceiling fan in FIG. 1 and components thereof.
Figure 3B:
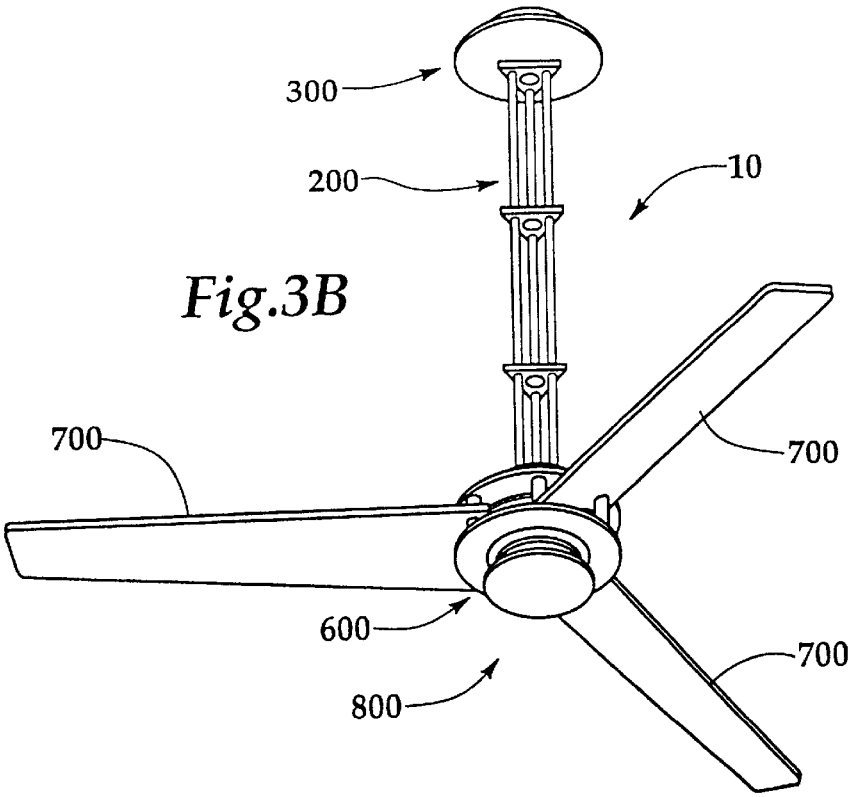
Figure 3C:
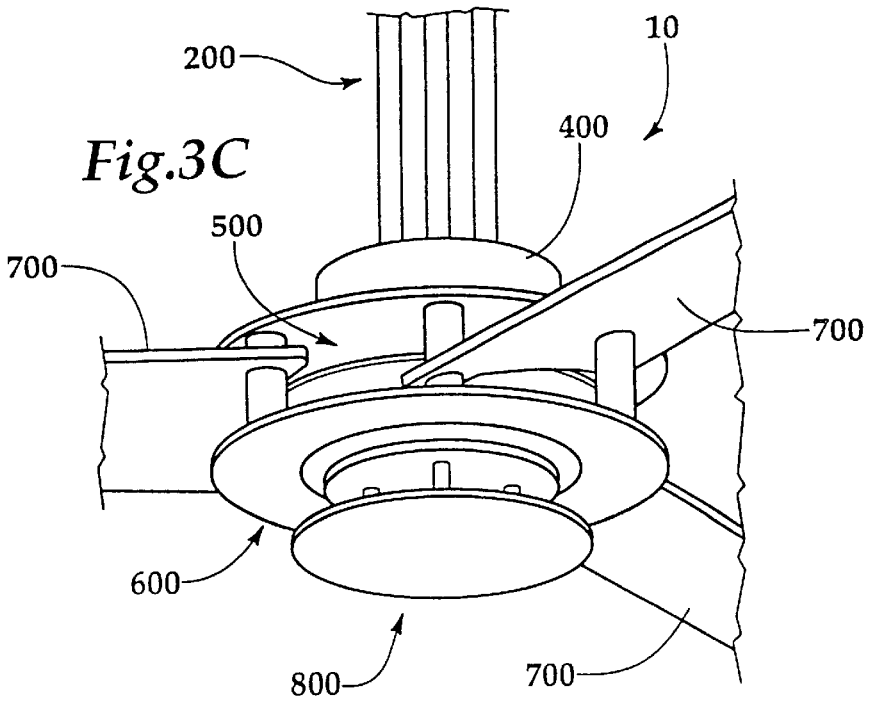
Figure 3D:
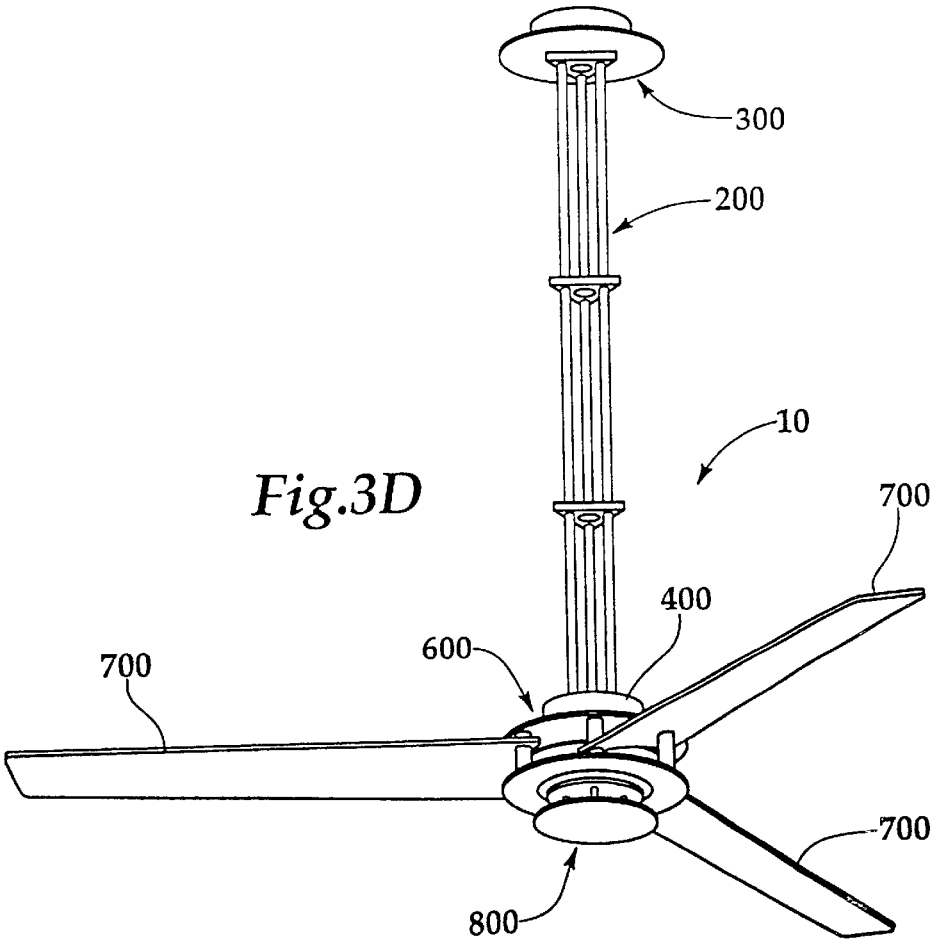

Referring now to the drawings, and in particular, to FIGS. 1, 2, and 3A–C, there is shown one embodiment of the present invention illustrated as a ceiling fan 10. The ceiling fan 10 generally comprises a downrod assembly 200, an upper canopy assembly 300 disposed at the upper end of the downrod assembly 200, a lower canopy 400 disposed at a lower end of the downrod assembly 200, a motor assembly 500 secured to the downrod assembly 200 below the lower canopy 400, a motor housing/blade mounting assembly 600 secured to the motor assembly 500, a plurality of blades 700 secured to the motor housing/blade mounting assembly 600, and a hub or platter assembly 800 disposed below the motor assembly 500. The downrod assembly includes a plurality of downrods 220 with a plurality of downrod ties 240 secured to the downrods 220.

Figure 4:
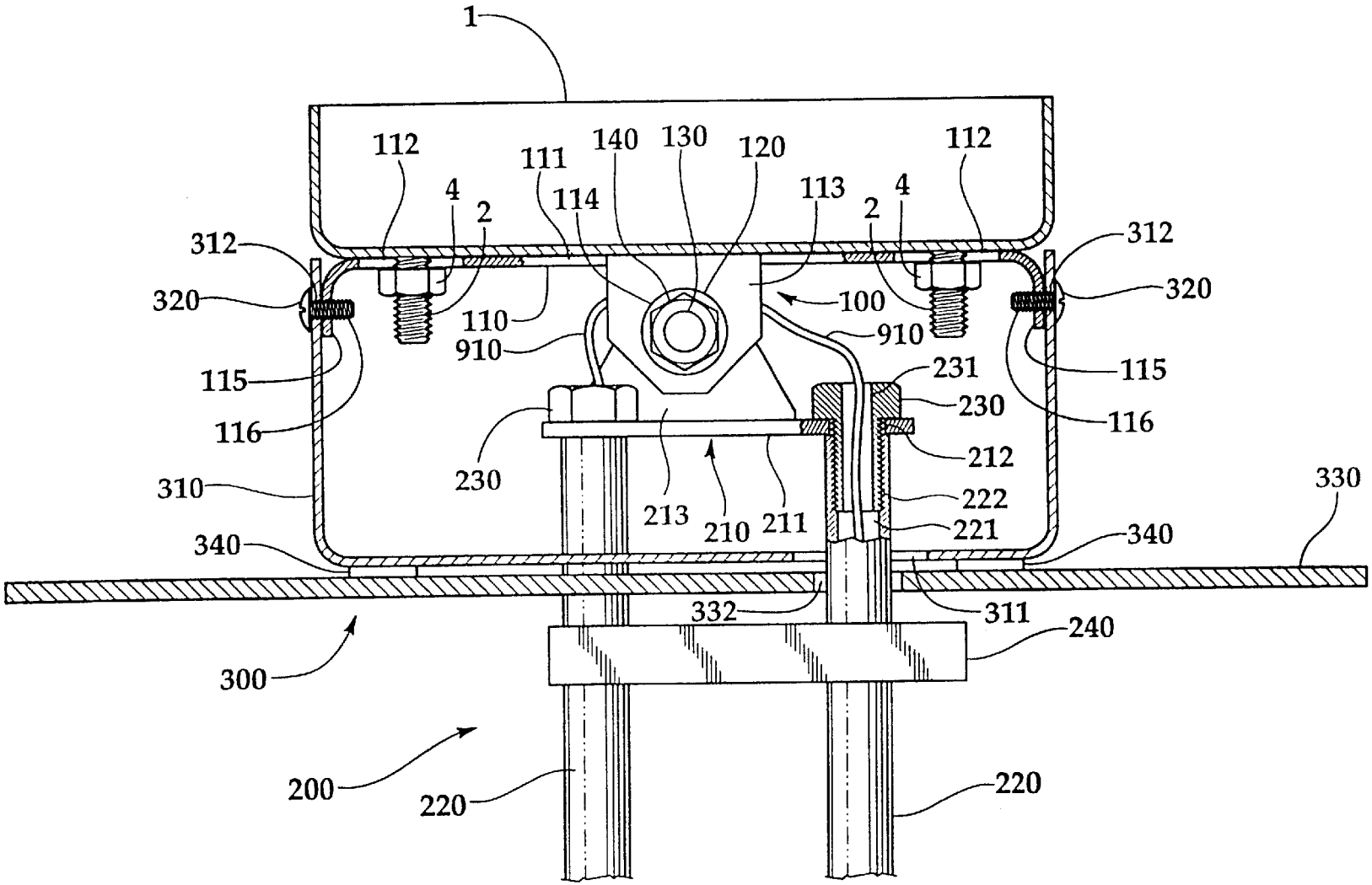
FIG. 4 shows a fragmentary partially cross-sectioned view of the downrod assembly, and upper canopy assembly of the ceiling fan in FIG. 1, and a ceiling bracket assembly and an electrical outlet fixture for mounting the ceiling fan.
Figure 6:
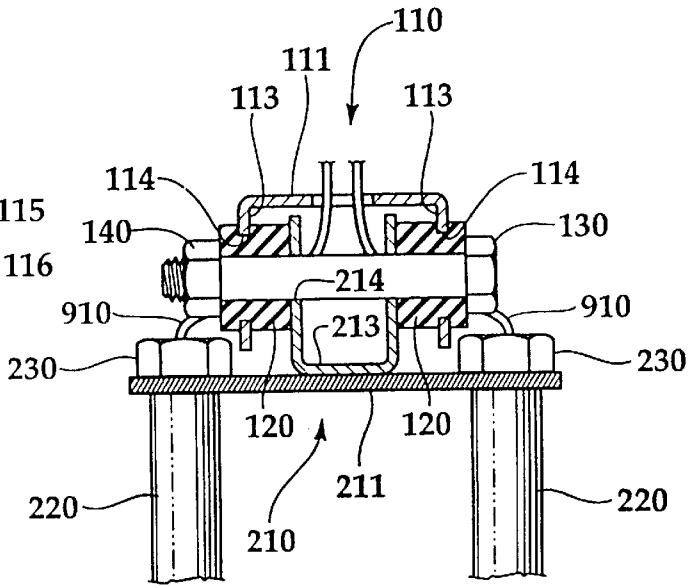
FIG. 6 shows a cross-sectional view of the upper portion of the downrod assembly and the ceiling bracket assembly in FIG. 5, taken about the section line 6—6.
Figure 5:
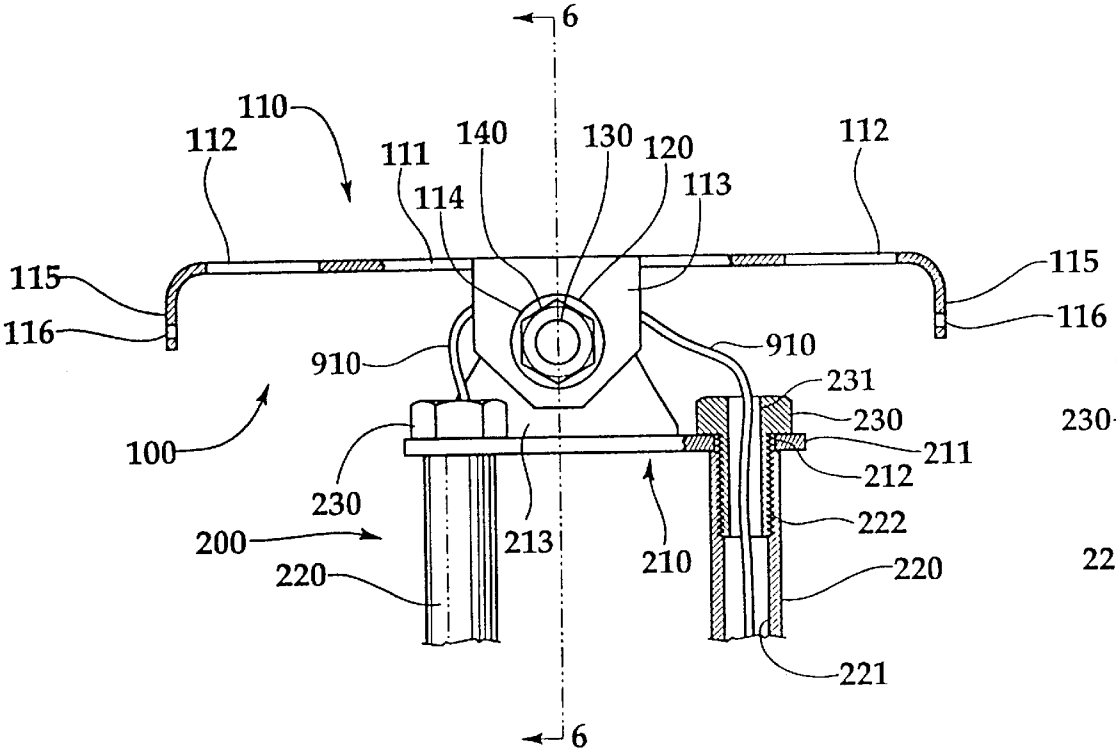
FIG. 5 shows a fragmentary partially cross-sectioned view of the ceiling bracket assembly and an upper portion of the downrod assembly in FIG. 4.

Referring now to FIGS. 4–6, there is shown one embodiment of mounting the ceiling fan 10. An electrical outlet box 1 is preferably secured to a ceiling (not shown) and has outlet box mounting screws 2 extending therefrom. A ceiling bracket assembly 100 is secured to the electrical outlet box 1 and provides a mounting location for the downrod assembly 200 and the upper canopy assembly 300. Alternatively, the ceiling bracket assembly 100 can be mounted directly to the ceiling in place of the electrical outlet box 1. The ceiling bracket assembly 100 includes a ceiling bracket 110, ceiling pivot bushings 120, a ceiling pivot bolt 130, and a ceiling pivot nut 140. The ceiling bracket 110 has a ceiling bracket mounting plate 111 with ceiling bracket mounting slots 112 for the outlet box mounting screws 2 of the electrical outlet box 1. Outlet box mounting nuts 4 engage the outlet box mounting screws 2 and secure the ceiling bracket mounting plate 111 to the electrical outlet box 1. Ceiling bracket pivot arms 113 extend downwardly from the ceiling bracket mounting plate 111 and have ceiling bracket pivot apertures 114 therein. The ceiling pivot bushings 120 are disposed within the ceiling bracket pivot apertures 114 of the ceiling bracket pivot arms 113. The ceiling pivot bushings 120 are preferably formed from rubber or other such dampening material.

Still referring to FIGS. 4–6, the downrods 220 are tubes which are secured to an upper downrod bracket 210. The upper downrod bracket 210 has an upper downrod bracket plate 211 with upper downrod bracket plate apertures 212. Upper downrod fasteners 230 pass through the upper downrod bracket plate apertures 212 and engage downrod upper internal threads 222 in the downrods 220, thereby securing the downrods 220 to the upper downrod bracket plate 211. Upper downrod bracket pivot arms 213 extend upwardly from the upper downrod bracket plate 211 and have upper downrod bracket pivot apertures 214 therein. The ceiling pivot bolt 130 extends through the ceiling pivot bushings 120 and the upper downrod bracket pivot apertures 214 to allow the downrod assembly 200 to pivotally hang from the ceiling bracket assembly 100. The upper downrod bracket pivot arms 213 are disposed between the ceiling pivot bushings 120, which position the upper downrod bracket pivot arms 213 between the ceiling bracket pivot arms 113. The ceiling pivot nut 140 secures the ceiling pivot bolt 130 in position.

Referring still to FIGS. 4–6, the purpose of the arrangement to suspend the downrod assembly 200 from the ceiling bracket assembly 100 is to provide a method of hanging the fan that would be secure, prevent the motor from torquing about the vertical axis, and allow the ceiling fan 10 to self adjust in the horizontal axis to hang plumb. To this end, the arrangement of the ceiling bracket 110 and the upper downrod bracket 210 can be reversed. For example, the ceiling pivot bushings can be mounted on the upper downrod bracket pivot arms in place of the ceiling bracket pivot arms. Also, the upper downrod bracket pivot arms can be disposed outside of the ceiling bracket pivot arms. Additionally, the downrods 220 are positioned on the upper downrod bracket 210 such that each of the downrods 220 support about the same amount of weight or force from the ceiling fan 10. In the example shown in FIGS. 5–6 having three downrods 220, the two downrods on the same side of the ceiling pivot bolt 130 are positioned closer to the pivot bolt 130 than the single downrod 220 on the opposite side of the pivot bolt 130.

Figure 8:
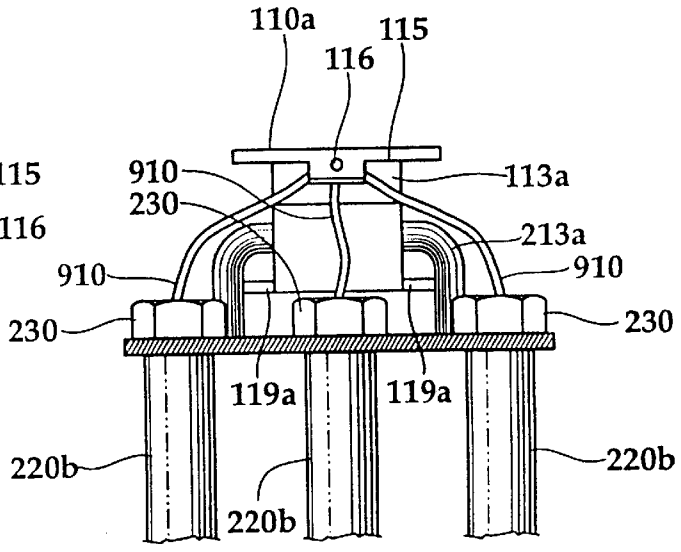
FIG. 8 shows a fragmentary partial front view of the ceiling bracket assembly and upper portion of the downrod assembly from FIG. 7.
Figure 7:
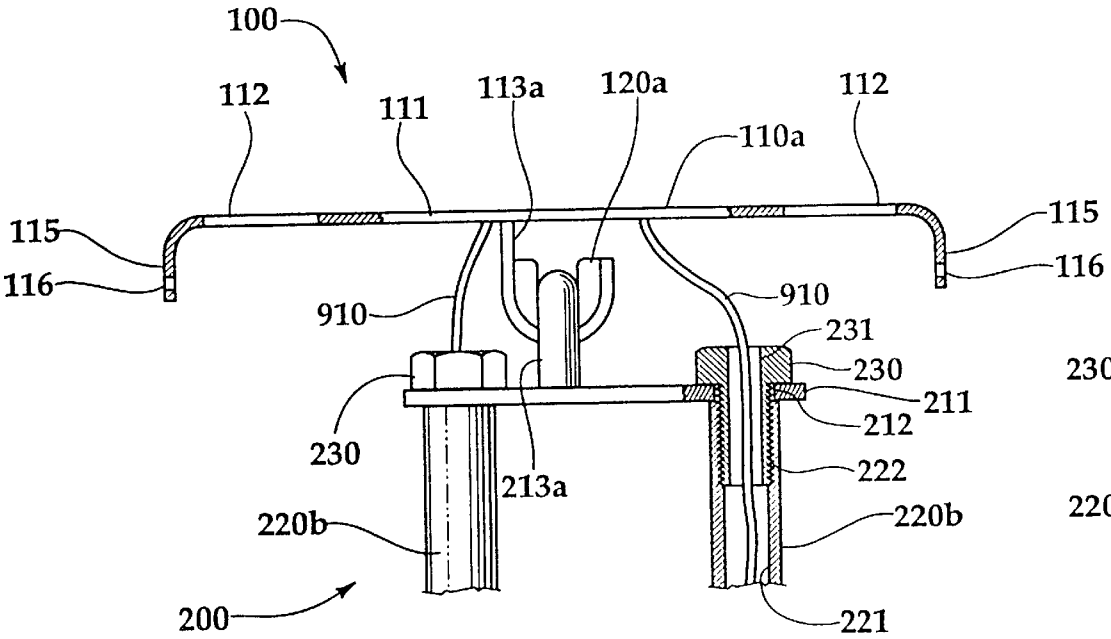
FIG. 7 shows a fragmentary partially cross-sectioned view illustrating an alternate embodiment of the ceiling bracket assembly and upper portion of the downrod assembly from FIG. 4.

Referring now to FIGS. 7 and 8, there is shown another embodiment of the ceiling bracket 110 shown in FIGS. 4–6, illustrated as the ceiling bracket 110*a*. The ceiling bracket 110*a* is similar to the ceiling bracket 110 in FIGS. 4–6, however, the ceiling bracket 110*a* includes a hook 113*a* in place of the ceiling bracket pivot arms 113, and a dampening lining 120*a* disposed within the hook 113*a* in place of the ceiling pivot bushings 120. To accommodate the ceiling bracket 110*a,* an alternate upper downrod bracket 210*a* is used in place of the upper downrod bracket 210 of the downrod assembly 200 in FIGS. 4–6. The upper downrod bracket 210*a* includes a U-shaped axis bracket 213*a* in place of the upper downrod bracket pivot arms 213 of the upper downrod bracket 210. The U-shaped axis bracket 213*a* is disposed within the dampening lining 120*a* in the hook 113*a* of the ceiling bracket 110*a*. The dampening lining 120*a* is preferably formed from rubber or other such dampening material. The hook 113*a* includes spacer tabs 119*a* that hold the U-shaped axis bracket 213*a* in position on the hook 113*a* of the ceiling bracket 110*a*. In this manner, the downrod assembly 200 can be pivotally suspended from the ceiling bracket 110*a*. In another embodiment, the hook can be part of the ceiling bracket and the U-shaped axis bracket can be part of the upper downrod bracket.

Figure 9:
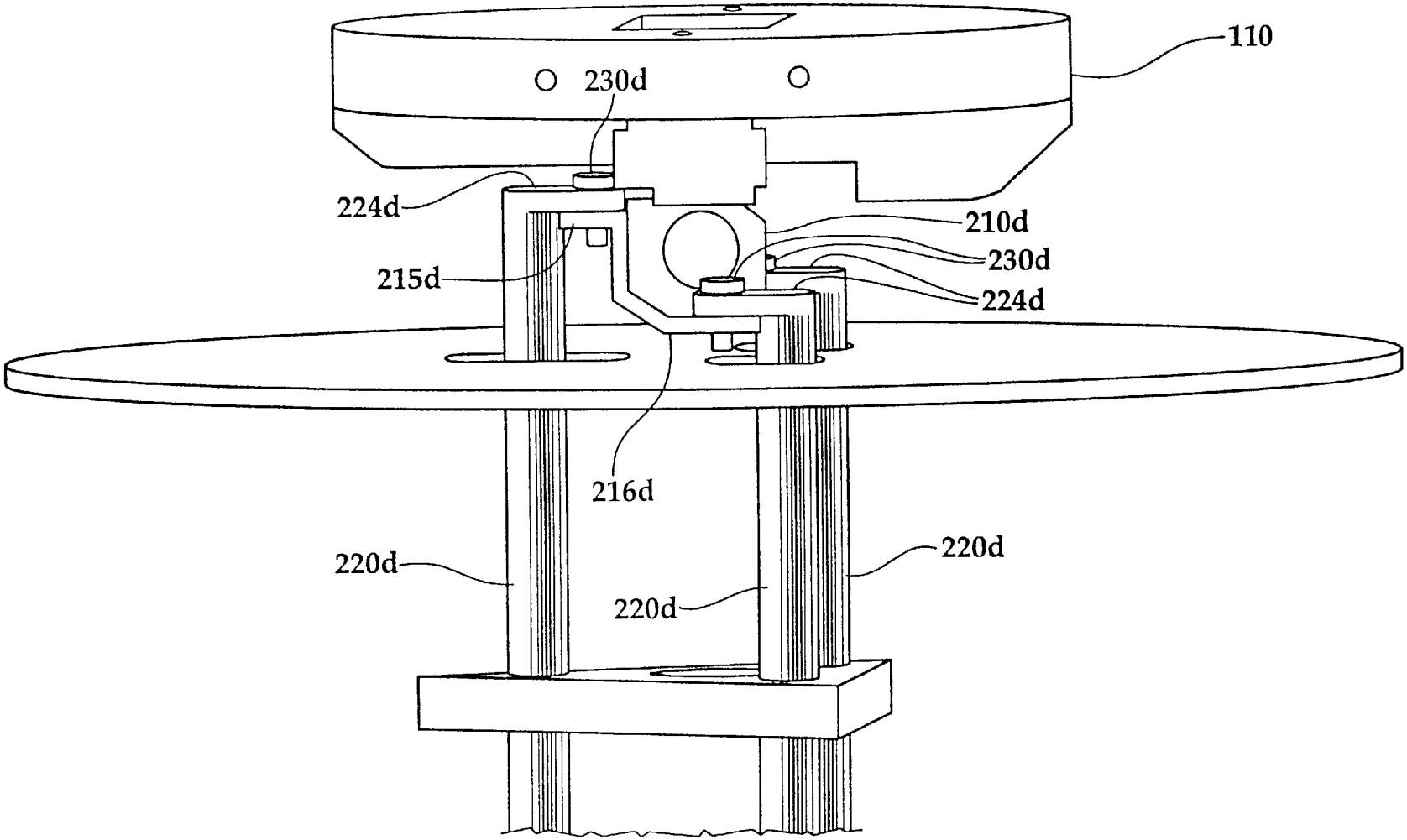
FIG. 9 shows a fragmentary partially cross-sectioned view illustrating an another embodiment of the upper downrod bracket assembly and downrods the downrod assembly from FIG. 4.

Referring now to FIG. 9, there is shown another embodiment of the upper downrod bracket 210 and the downrods 220 in FIG. 4, illustrated as an upper downrod bracket 220*d* and downrods 220*d*. The upper downrod bracket 210*d* has an upper downrod bracket plate 211*d* with an upper downrod bracket plate top portion 215*d* and an upper downrod bracket plate lowered portion 216*d*. The lowered downrod bracket lowered portion 216*d* allows the upper downrod bracket 210*d* to pivot relative to the ceiling bracket 110 a greater degree than the upper downrod bracket 110 in FIG. 4, for accommodating angled ceilings.

Still referring to FIG. 9, the downrods 220*d* include upper downrod tabs 224*d* with upper downrod mounting apertures 225*d*. The upper downrod tabs 224*d* rest on top of the upper downrod bracket 210*d,* and are secured to the upper downrod bracket 210*d* by upper downrod fasteners 230*d*. The use of the upper downrod tabs 224*d* transfers the weight and force from the downrods 220*d* to the upper downrod bracket 210*d* without relying on the upper downrod fasteners 230*d* to provide vertical support to the downrods 220*d*.

Figure 10:
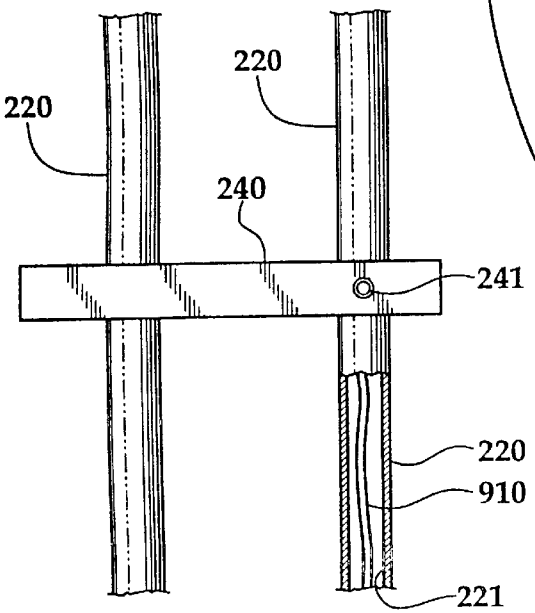
FIG. 10 shows a fragmentary partially cross-sectioned view of the downrod assembly from the ceiling fan in FIG. 1, illustrating the securement of the rod ties and passage of the electrical wiring therethrough.

Referring now to FIGS. 4 and 10, the downrods 220 are hollow tubes with a downrod inner passage 221 and the upper downrod fasteners 230 have upper downrod fastener apertures 231 that communicate with the inner passage 221 of the downrods 220. Electrical wiring 910 for operation of the fan extend through an opening in the electrical outlet box 1 and the ceiling bracket mounting plate 111, and pass through the upper downrod fastener aperture 231 and the inner passage 221 of the downrods 220 to the motor assembly 500. The downrod ties 240 are secured to the to the downrods 220 by downrod tie set screws 241. Although the downrod ties 240 are illustrated as being secured to the downrods by set screws 241, other methods of securing the downrod ties 240 are contemplated as being part of the present invention, such as retaining rings, pins, mechanical fasteners, adhesives, or the like.

Figure 11:
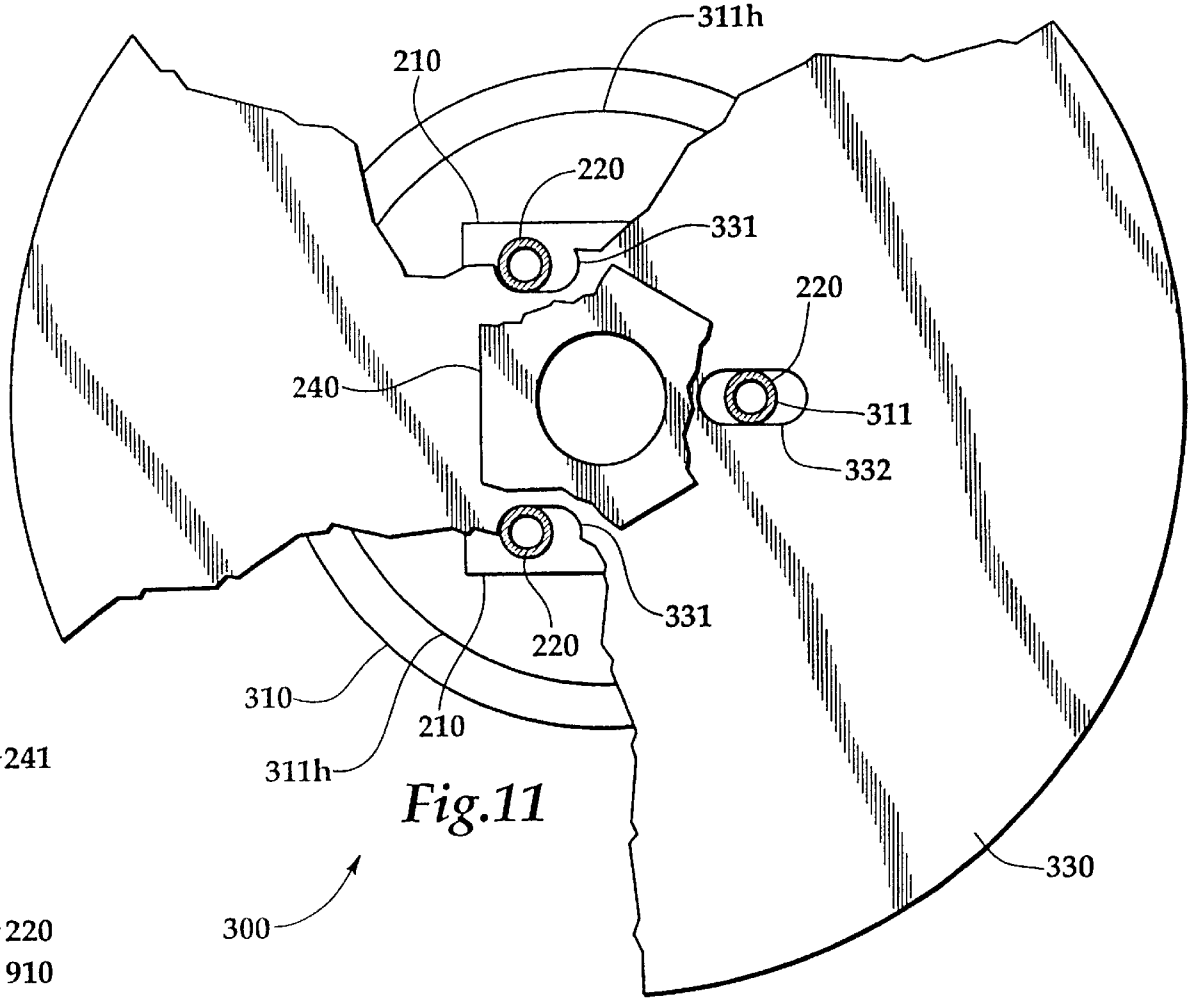
FIG. 11 shows a fragmentary partial view of an upper portion of the downrod assembly and the upper canopy assembly from the ceiling fan in FIG. 1.

Referring now to FIGS. 4 and 11, the upper canopy assembly 300 conceals the components used to attach the ceiling fan 10 to the ceiling, and includes an upper canopy 310 and a ceiling cover 330. The upper canopy 310 is secured to ceiling bracket canopy mounting flanges 115 in the ceiling bracket 110. The upper canopy 310 is secured to the ceiling bracket canopy mounting flanges 115 by upper canopy mounting screws 320 that pass through upper canopy screw apertures 312 in the upper canopy 310 and engage canopy mounting screw apertures 116 in the ceiling bracket canopy mounting flanges 115. Although the upper canopy 310 is illustrated as being secured to the ceiling bracket 110 by screws, other methods of attachment are contemplated as being included in the present invention, and include, without limitation, such as screws, hook and pile fasteners, adhesive, rivets, mechanical fasteners, and the like. In the embodiment in FIG. 4, the downrods 220 pass through downrod clearance slots 311 in the upper canopy 310. In the embodiment in FIG. 11, the downrods 220 pass through a downrod control aperture 311*h* in the upper canopy 310. The downrod clearance slots 311 and downrod control aperture 311*h* allow the downrods to pass through the upper canopy 310 when the ceiling fan 10 is hung from a horizontal ceiling or from a sloped ceiling. Alternatively, the upper canopy 310 can have a large opening that allows all of the downrods 220 to pass through the upper canopy 310.

Still referring to FIGS. 4 and 11, the ceiling cover 330 is secured to the upper canopy 310 by adhesive tape 340. However, any fastening device such as screws, hook and pile fasteners, adhesive, rivets, mechanical fasteners, and the like can be used to secure the ceiling cover 330 to the upper canopy 310. The ceiling cover 300 has two downrod clearance short slots 331 for the two downrods 220 that are disposed on the same side of the downrod pivot axis, and a downrod clearance long slot 332 for the downrod 220 disposed on the opposite side of the downrod pivot axis. The downrod clearance short slots 331 and the downrod clearance long slot 332 are disposed in the ceiling cover 330 such that the rod tie 240 will cover the slots 331 and 332. The ceiling cover 330 covers a portion of the portion of the upper canopy 310, and in the illustrated embodiment, the ceiling cover 330 covers all of the upper canopy 310. As illustrated, the ceiling cover 330 is a flat round metal plate. However, the ceiling cover 330 can have any other shape than round, such as square, hexagonal, etc. Furthermore, the ceiling cover 330 is not required to be flat, and can have any other form that will allow it to perform a decorative and/or concealment function.

Figure 12:
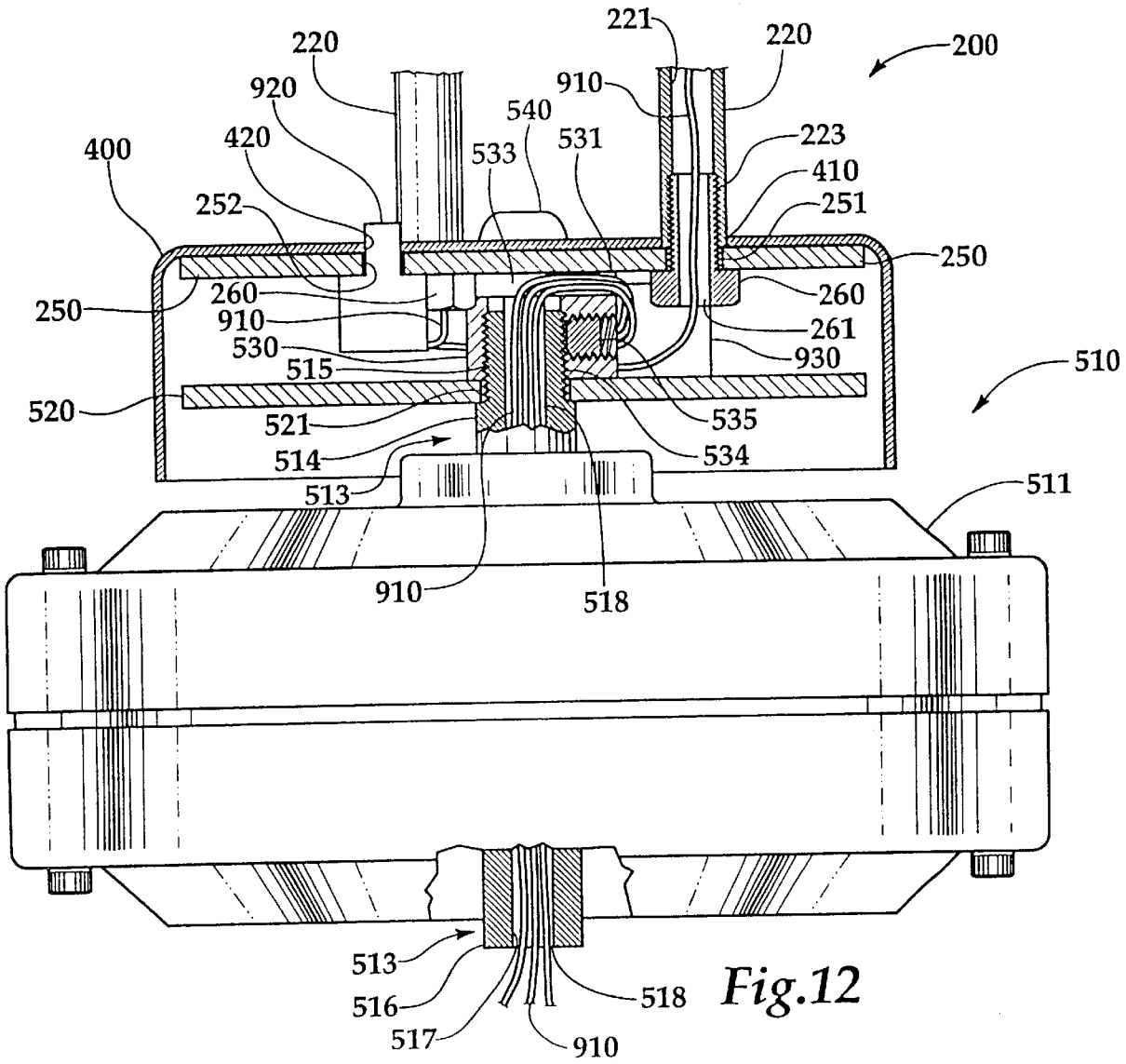
FIG. 12 shows a fragmentary partially cross-sectioned view of the lower portion of the downrod assembly, lower canopy, and motor assembly from the ceiling fan in FIG. 1.

Referring now to FIG. 12, the downrod assembly 200 also includes a lower downrod bracket 250 with lower downrod bracket apertures 251. Lower downrod fasteners 260 pass through the lower downrod bracket apertures 251 and engage downrod lower internal threads 223 in the downrods 220, thereby securing the downrods 220 to the lower downrod bracket 250. Lock washers can be used with the lower downrod fasteners 260 to inhibit the lower downrod fasteners 260 from coming loose from the downrod lower internal threads 223. The lower down rod fasteners 260 have lower down rod fastener apertures 261 for the electrical wires 910 to pass through and exit the downrods 220 of the down rod assembly 200. In another embodiment, the downrods 220 can have separate openings for the electrical wires to pass through and exit the downrod inner passage 221. The lower canopy 400 is positioned above the lower downrod bracket 250, and extends below the lower downrod bracket 250. The downrods 220 pass through lower canopy downrod apertures 410 in the lower canopy 400. In another embodiment, the downrods 220 are secured to the lower downrod bracket 250 by external threads on the downrods 220 that engage internal threads in the lower bracket downrod apertures 251 of the lower downrod bracket 250. In yet another embodiment, the downrods 220 can be secured to the lower downrod bracket 220 by welding, swaging, riveting, mechanical fasteners, adhesives, or the like.

Figure 13:
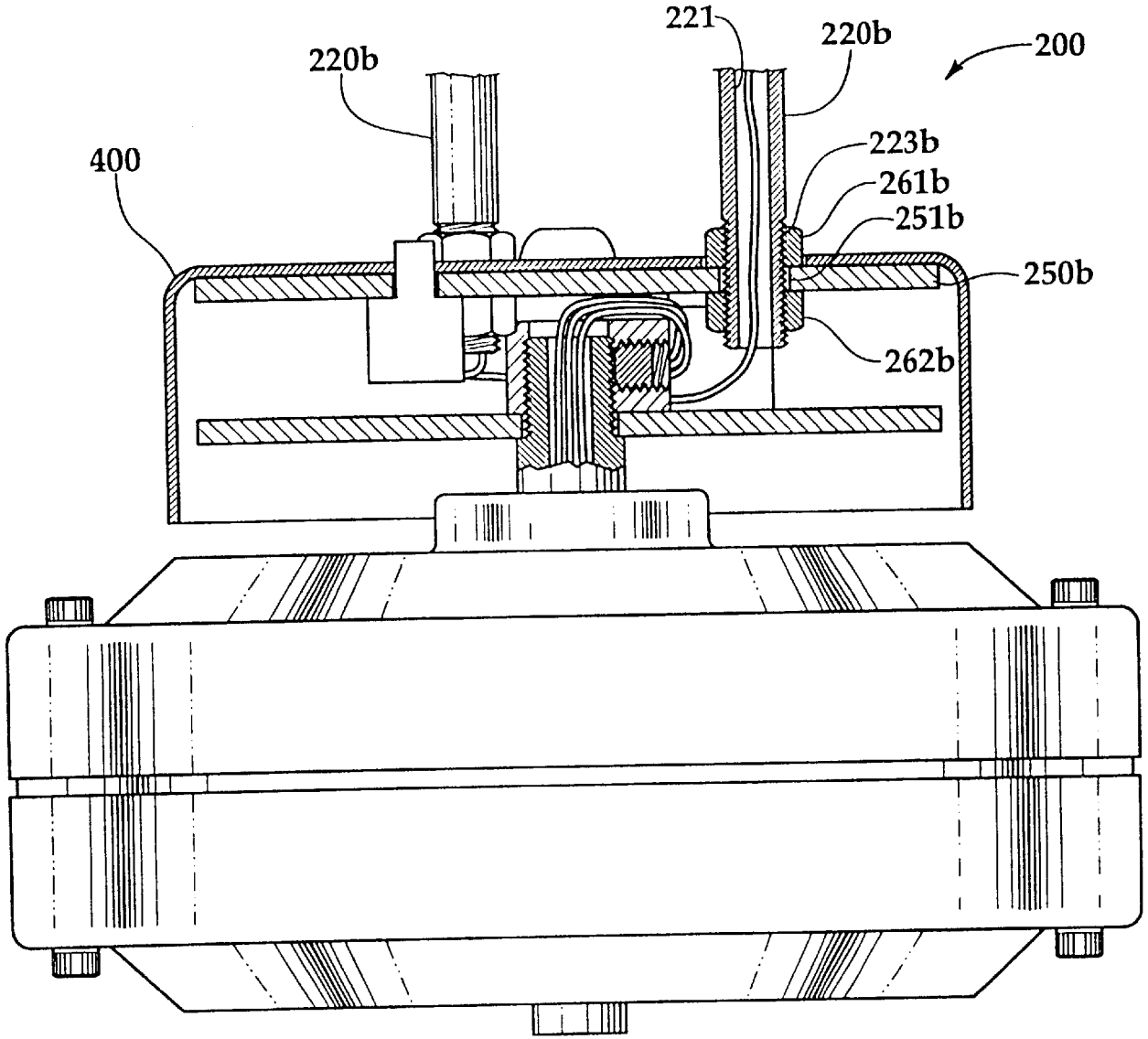
FIG. 13 shows fragmentary, partially cross-sectioned view illustrates an alternative embodiment of the lower portion of a downrod assembly in FIG. 12.

Referring now to FIG. 13, there is shown another embodiment of mounting the downrods 220 to the lower downrod bracket 250 in FIG. 12, illustrated as downrods 220*b* and the lower downrod bracket 250*b*. The downrods 220*b* include downrod lower external threads 223*b* in place of the downrod lower internal threads 223 of the downrods 220 in FIG. 12. The lower downrod bracket 250*b* includes lower downrod bracket apertures 251*b* in place of the lower downrod bracket apertures 251 in the lower downrod bracket 250 in FIG. 12, that are sufficiently large to allow the downrods 220*b* to pass therethrough. Also, lower downrod top fasteners 261*b* and lower downrod bottom fasteners 262*b* are used in place of the lower downrod fasteners 260 in FIG. 12. The lower downrod top fasteners 261*b* and the lower downrod bottom fasteners 262*b* engage the downrod lower external threads 223*b* and secure the lower downrod bracket 250*b* therebetween. In this manner, the lower downrod bracket 250*b* is secured to the downrods 220*b*. Lock washers can be used with the lower downrod top and bottom fasteners 261*b* and 262*b* to inhibit the lower downrod fasteners 261*b* and 262*b* from coming loose from the lower downrod bracket 250*b*. A lower canopy 400*b* is used in place of the lower canopy 400 in FIG. 12, and has lower canopy downrod apertures 410*b* in place of the lower canopy downrod apertures 410. The lower canopy downrod apertures 410*b* provide clearance for the lower downrod top fasteners 261*b*.

Figure 15:
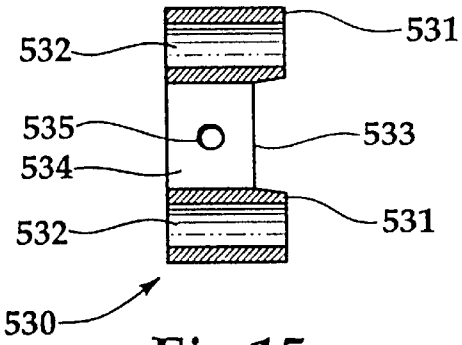
FIG. 15 shows a cross-sectional view of the motor mounting nut from FIG. 14, taken about the section lines 15—15.
Figure 14:
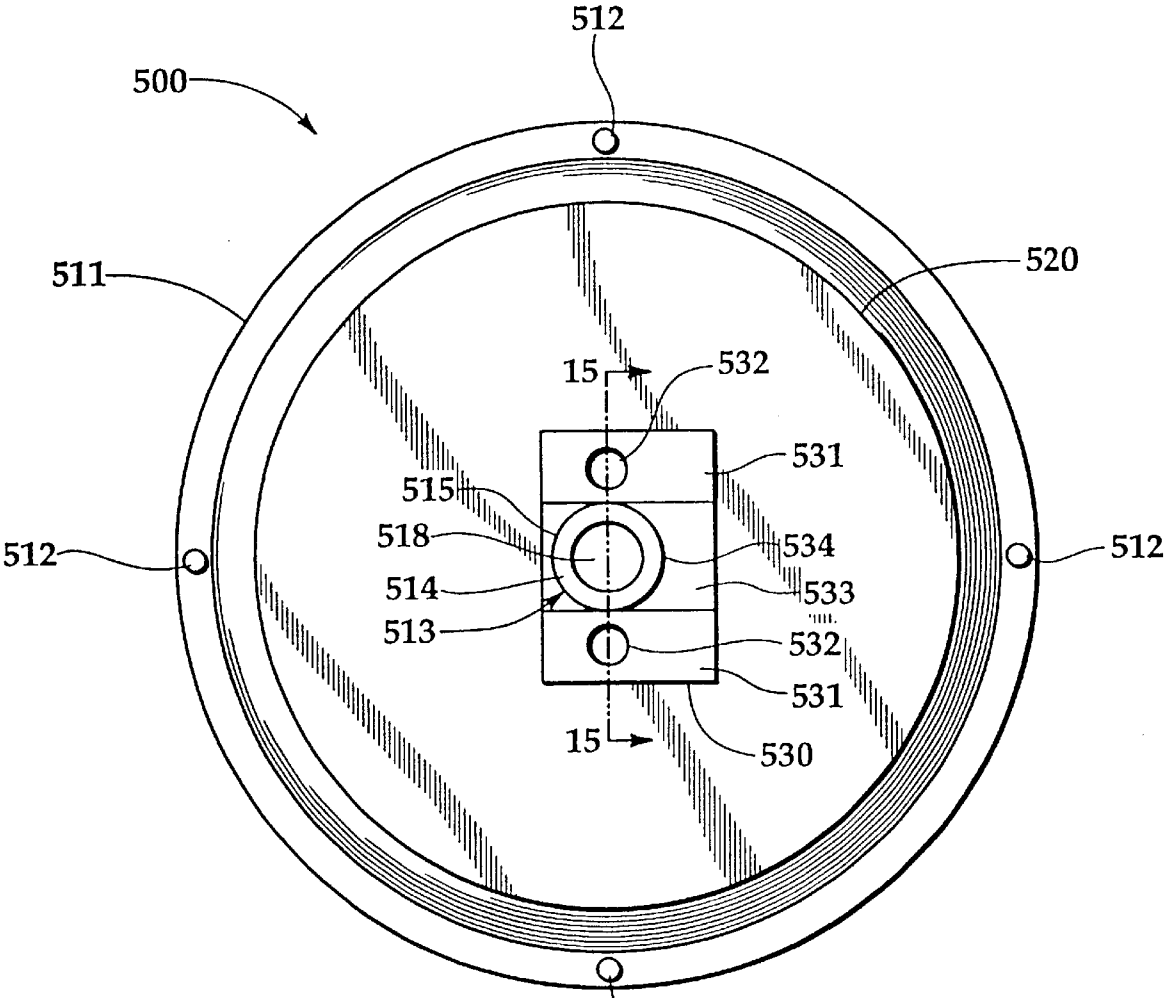
FIG. 14 shows a top view of the motor assembly from FIG. 12.

Referring now to FIGS. 12, 14, and 15, the motor assembly 500 generally includes a motor 510, a lower motor shield 520, and a motor mounting nut 530. The motor 510 has a motor body 511 and a motor shaft 513. The motor shaft 513 has a motor shaft upper portion 514 extending above the motor body 511 and a motor shaft lower portion 516 extending below the motor body 511. The motor shaft upper portion 514 has external motor threads 515, and the motor shaft lower portion 516 has internal motor threads 517. The motor shaft 513 also has a central passage 518 for the electrical wires 910 that operate the ceiling fan 10. The lower motor shield 520 has a lower motor shield shaft aperture 521. The motor mounting nut 530 includes downrod mounting extensions 531 that flank a central wiring clearance notch 533. Threaded downrod assembly mounting bores 532 extend downwardly into each of the downrod mounting extensions 531 of the motor mounting nut 530. A central threaded motor mounting bore 534 extends downwardly from the central wiring clearance notch 533 through the motor mounting nut 530.

Referring still to FIGS. 12, 14, and 15, the external motor threads 515 of the motor shaft upper portion 514 engage the central threaded motor mounting bore 534 through the end of the central threaded motor mounting bore 534 that is opposite of the central wiring clearance notch 533 in the motor mounting nut 530. A motor mounting set screw 535 disposed in the motor mounting nut 530 engages the motor shaft upper portion 514 and prevents the motor mounting nut 530 from rotating on the external motor threads 515 of the motor shaft upper portion 514, which secures the motor mounting nut 530 on the motor shaft 513. Although the motor nut 530 is illustrated as being secured to the motor shaft upper portion 514 by the set screw 535, other securing methods are contemplated as being part of the present invention such as a pin or wire, mechanical securing devices, adhesives, or the like.

Still referring to FIGS. 12, 14, and 15, the motor shaft upper portion 514 extends through the lower motor shield shaft aperture 521. The lower motor shield 520 is secured in the motor assembly 500 by the motor mounting nut 530 trapping the lower motor shield 520 between a stop land on the motor shaft upper portion 514, or by securing the lower motor shield 520 directly to the motor mounting nut 530 or the motor shaft upper portion 514. Mounting nut downrod fasteners 540 extend through lower canopy mounting apertures 430 in the lower canopy 400 and lower bracket mounting apertures 253 in the lower downrod bracket 250, and engage the threaded downrod assembly mounting bores 532 in the motor mounting nut 530. In one preferred embodiment, the mounting nut downrod fasteners 540 include nylon patches on the threads of the mounting nut downrod fasteners 540 to prevent the fasteners from coming loose. In this manner, the downrod assembly 200 and lower canopy 400 are secured to the motor assembly 500.

Figure 16:
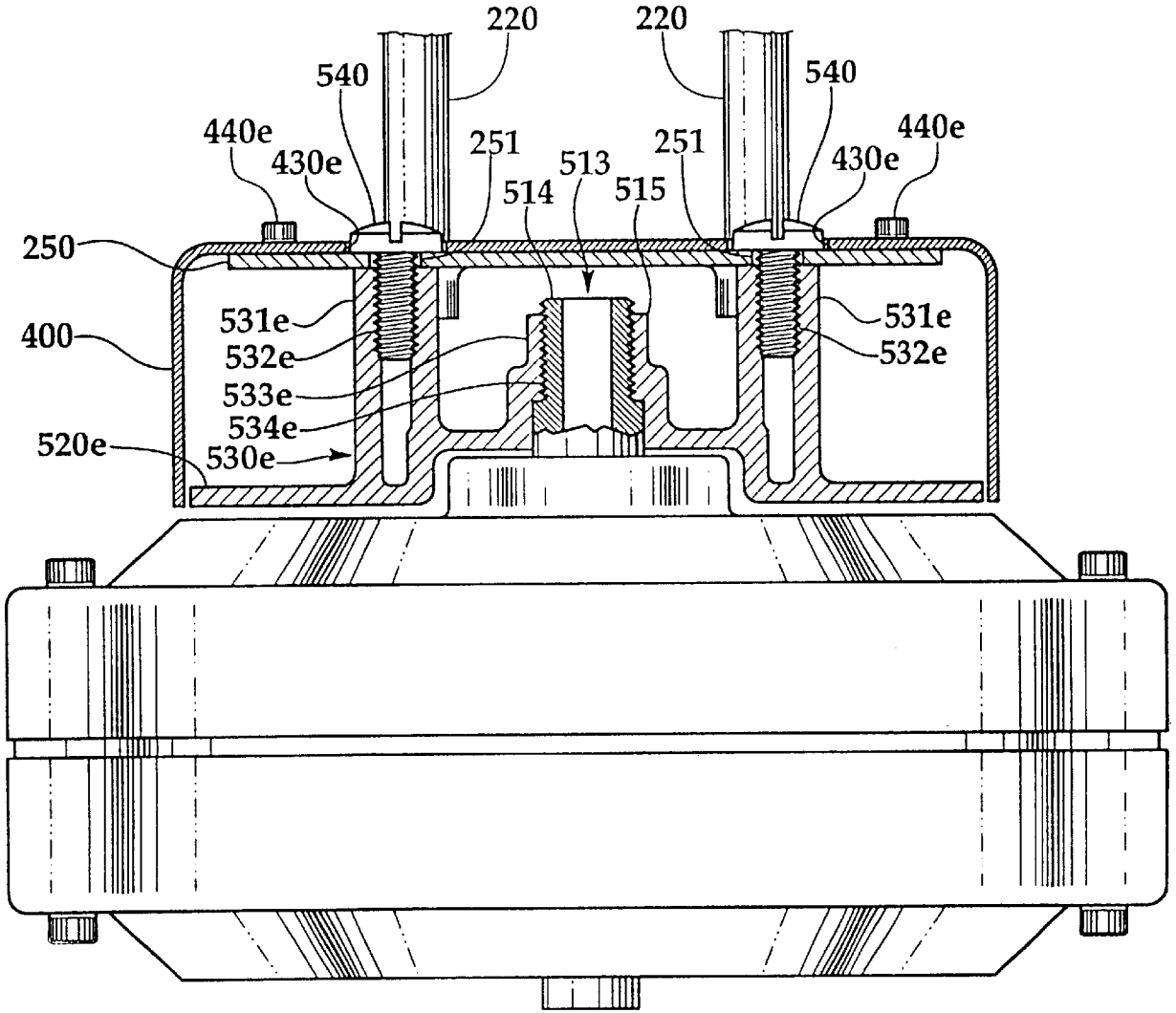
FIG. 16 shows a fragmentary partially cross-sectioned view illustrating an another embodiment of the motor nut, the lower motor shield, the lower downrod bracket assembly and downrods, and the lower canopy from FIG. 12.

Referring now to FIG. 16, there is shown another embodiment of the motor nut 530 and the lower motor shield 520 from the motor assembly 500 in FIG. 12, illustrated as the integral motor nut/shield 530*e*. A lower motor shield 520*e* extends from a central shaft mounting extension 533*e*. The central shaft mounting extension 533*e* has a central threaded motor mounting bore 534*e* extending therethrough, which engages the external motor threads 515 on the motor shaft upper portion 514. A set screw can be used to prevent the central threaded motor bore 534*e* from unscrewing from the external motor threads 514 similar to the set screw 535 in FIG. 12. Downrod assembly mounting extensions 531*e* extend upwardly from the lower motor shield 520*e* above the central shaft mounting extension 533*e* and have threaded downrod assembly mounting bores 532*e*. The mounting nut downrod assembly fasteners 540 secures the motor nut/shield 530*e* to the lower downrod bracket by passing through the lower downrod bracket apertures 251 and engaging the threaded downrod assembly mounting bores 532*e* in the downrod mounting extensions 531*e*.

Still referring to FIG. 16, in the embodiment illustrated the lower downrod bracket 250 is an integral part of the downrods 220. Also in the embodiment shown in FIG. 16, the lower canopy 400 is secured to the lower downrod bracket 250 by lower canopy screws 440*e* that pass through apertures in the lower canopy 400 and engage threaded apertures in the lower downrod bracket 250, and the mounting nut downrod assembly fasteners 540 are disposed in lower canopy clearance apertures 430*e*.

Referring back now to FIG. 12, a reversing switch 920 is mounted in a lower downrod bracket switch aperture 252 in the lower downrod bracket 250 and a lower canopy switch aperture 420 in the lower canopy 400. A capacitor 930 is mounted to the lower motor shield 520 below the lower canopy 400. Alternatively, the reversing switch 920 and/or the capacitor 930 can be mounted to the lower canopy 400, the lower motor shield 520, the lower downrod bracket 250, or in a separate compartment located underneath the motor. The electrical wiring 910 for operating the ceiling fan 10 exits the downrod assembly 200 between the lower downrod bracket 250 and the lower mounting shield 520 and is connected to the reversing switch 920 and the capacitor 930 in the ordinary manner for a conventional ceiling fan. The electrical wiring 910 is disposed between the lower downrod bracket 250 and the lower mounting shield 520 and are routed to the motor 510 through the central wiring clearance notch 533 and the central threaded motor mounting bore 534 in the motor mounting nut 530, and through the central motor shaft passage 518 in the motor shaft 513. The lower mounting shield 520 provides a barrier between the electrical wiring 910 and the motor body 511.

Referring now to FIGS. 17, 18A–B, and 19A–B, the motor housing assembly 600 generally includes a first ring or lower housing bracket 610 and an or second ring 670. The lower housing bracket 610 is secured to the motor body 511 by a lower housing bracket fastening device 620 such as adhesive tape. Although the lower housing bracket fastening device 620 is illustrated herein as an adhesive tape, other fastening devices are contemplated as being part of the invention such as mechanical fasteners, adhesives, or the like. Additionally, the lower housing bracket 610 can be an integral part of the motor body 511 by forming the lower housing bracket 610 with the motor body 511, by welding the lower housing bracket 610 to the motor body 511, or the like. Forward lower spacers 630 and aft lower spacers 640 extend upwardly on the lower housing bracket 610. Furthermore, the housing assembly 600 can be secured to the motor body 511 by securing the upper housing bracket 670 to the lower housing bracket 610 with the motor body 511 secured therebetween. In one embodiment the forward lower spacer 630 and the aft lower spacer 640 are formed as an integral part of the lower housing mounting bracket 610 by forming the spacers 630 and 640 with the lower housing bracket 610, by welding the spacers 630 and 640 onto the lower housing bracket 610, or the like. The forward lower spacer 630 and the aft lower spacer 640 include studs 631 and 641, respectively, extending upwardly.

Referring still to FIGS. 17, 18A–B, and 19A–B, the upper housing bracket 670 has forward upper spacers 650 and aft upper spacers 660 that extend downwardly at locations which correspond with the forward lower spacer 630 and the aft lower spacer 640, respectively, on the lower housing bracket 610. In one embodiment the forward upper spacer 650 and the aft upper spacer 660 are formed as an integral part of the upper housing bracket 670 by forming the spacers 650 and 660 with the upper housing bracket 670, by welding the spacers 650 and 660 onto the upper housing bracket 670, or the like. The upper housing bracket includes stud apertures 675 and 676 extending downwardly through the spacers 650 and 660, respectively.

Still referring to FIGS. 17, 18A–B, and 19A–B, the studs 631 and 641 of the forward lower spacer 630 and the aft lower spacer 640 are disposed within forward and aft blade mounting apertures 721 and 722, respectively, in each of the corresponding blades 700. Motor housing nuts 680 pass through motor housing lock washers 690 and through each of the apertures 675 and 676 in the upper housing bracket 670 to engage the forward lower spacer stud 631 and the aft lower spacer stud 641. In this manner, the upper and lower portion 670 and 610 of the motor housing 600 are secured together with the motor body 511. Keyways 671 in the upper housing bracket 670 engage motor housing keys 512 on the motor body 511. In this arrangement, the motor housing assembly 600 is secured to, and rotates with the motor body 511. Also, the blades 700 are secured to the motor body 511 above a lower surface of the motor body 511. Although the fasteners bind together the upper housing bracket 670 and the lower housing bracket 610 of the motor housing 600 are illustrated as also securing the spacers 630, 640, 650, and 660, and the blades 700, the fasteners binding the upper portion and lower portion of the motor housing 600 can be independent of the spacers and the fan blades, and can be located in areas of the motor housing that are independent of the location of the spacers and blades.

Referring still to FIGS. 17, 18A–B, and 19A–B, in the embodiment illustrated, the blade mounting apertures 721 and 722 combine with the studs 631 and 641 to provide a function of preventing the blades 700 from disengaging from the motor housing 600. However, this function can also be performed by apertures in the blades 700 that engage other projections on the motor housing 600, or by projections on the blades 700 that engage apertures in the motor housing 600. In another embodiment, the blades 700 can be secured to the lower spacers, such as by a screw, and the upper spacers can rest on top of the of the blades to perform a decorative function. In yet another embodiment, the blades 700 can be secured to the upper spacers, such as by a screw, and the lower spacers can extend up to the blades to perform a decorative function.

Figure 17:
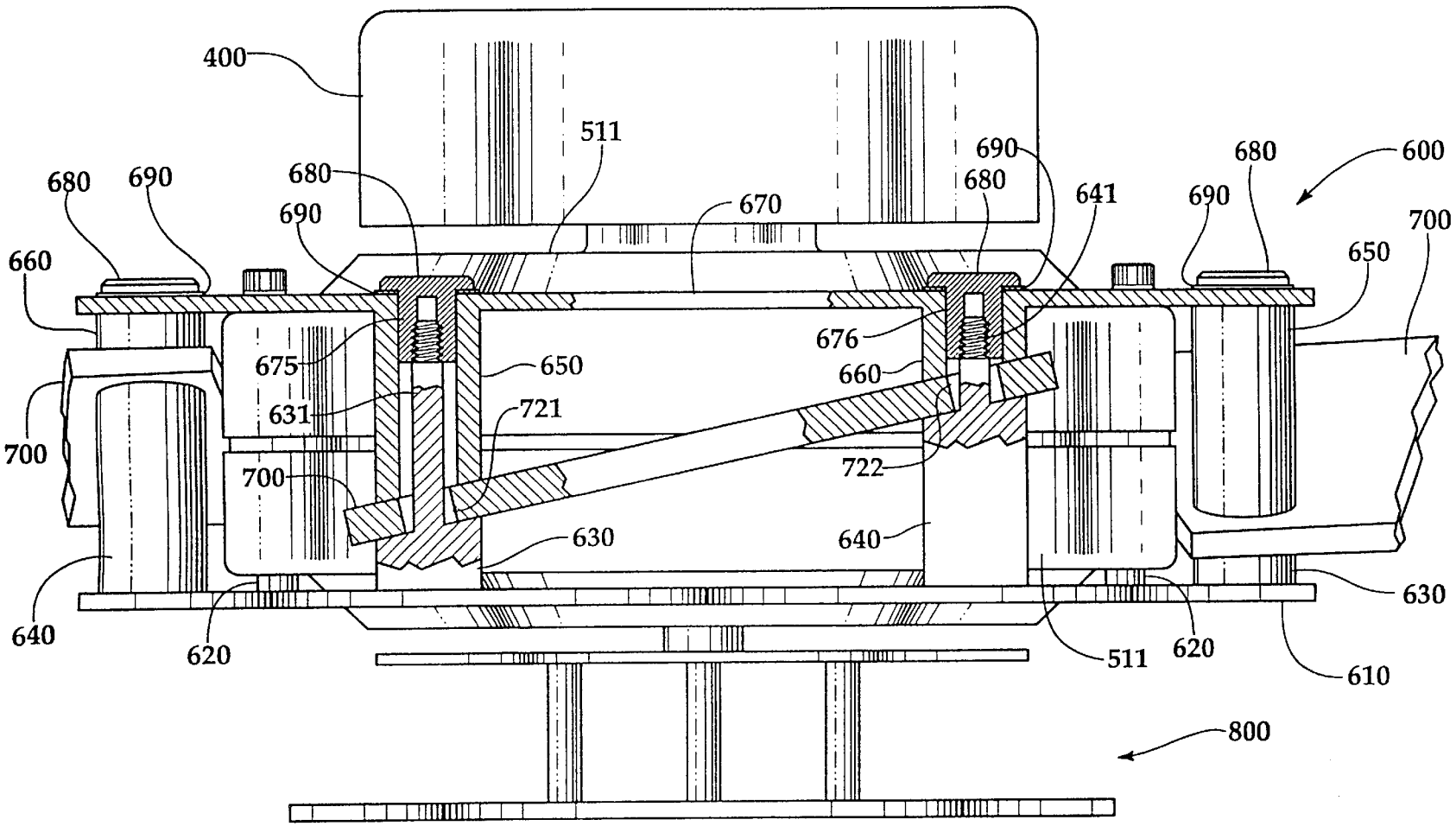
FIG. 17 is a side view of the lower canopy, motor assembly, housing assembly, blades, and lower platter assembly from the ceiling fan in FIG. 1, showing the motor housing assembly and blades in partial cross-section.
Figure 18A:
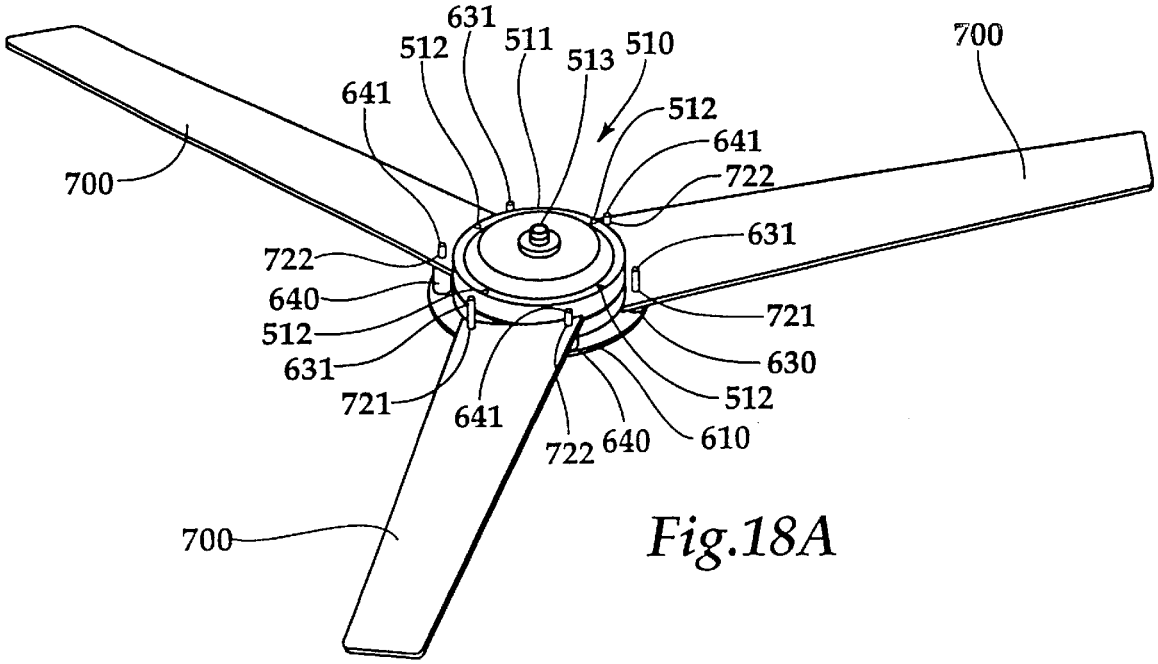
FIGS. 18A and 18B shows an upper perspective view and a side view, of the motor, lower portion of the motor housing assembly, and blades from FIG. 17.
Figure 18B:
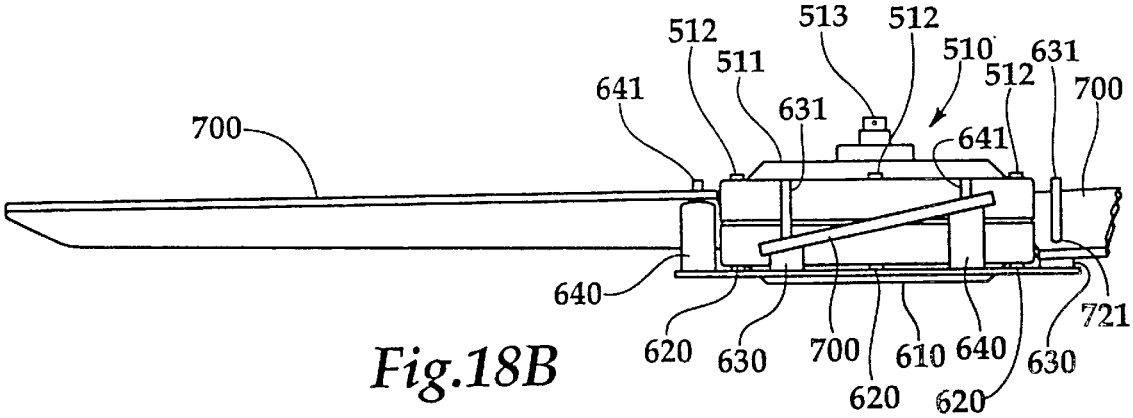
Figure 19A:
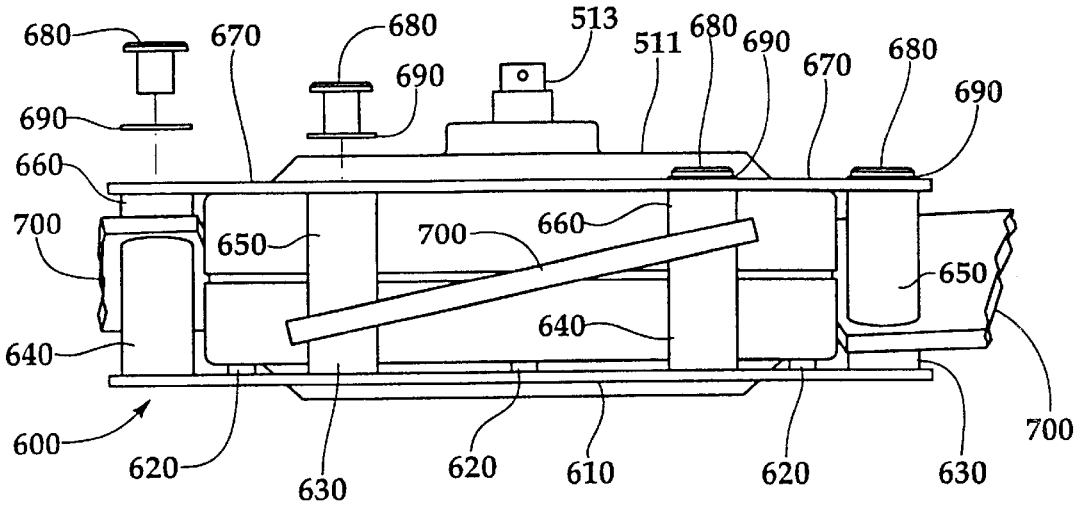
FIGS. 19 and 19B shows a side view and an upper perspective view of the motor, motor housing assembly, and blades from FIG. 17, showing partial exploded view of a portion of the fasteners securing the motor housing assembly.
Figure 19B:
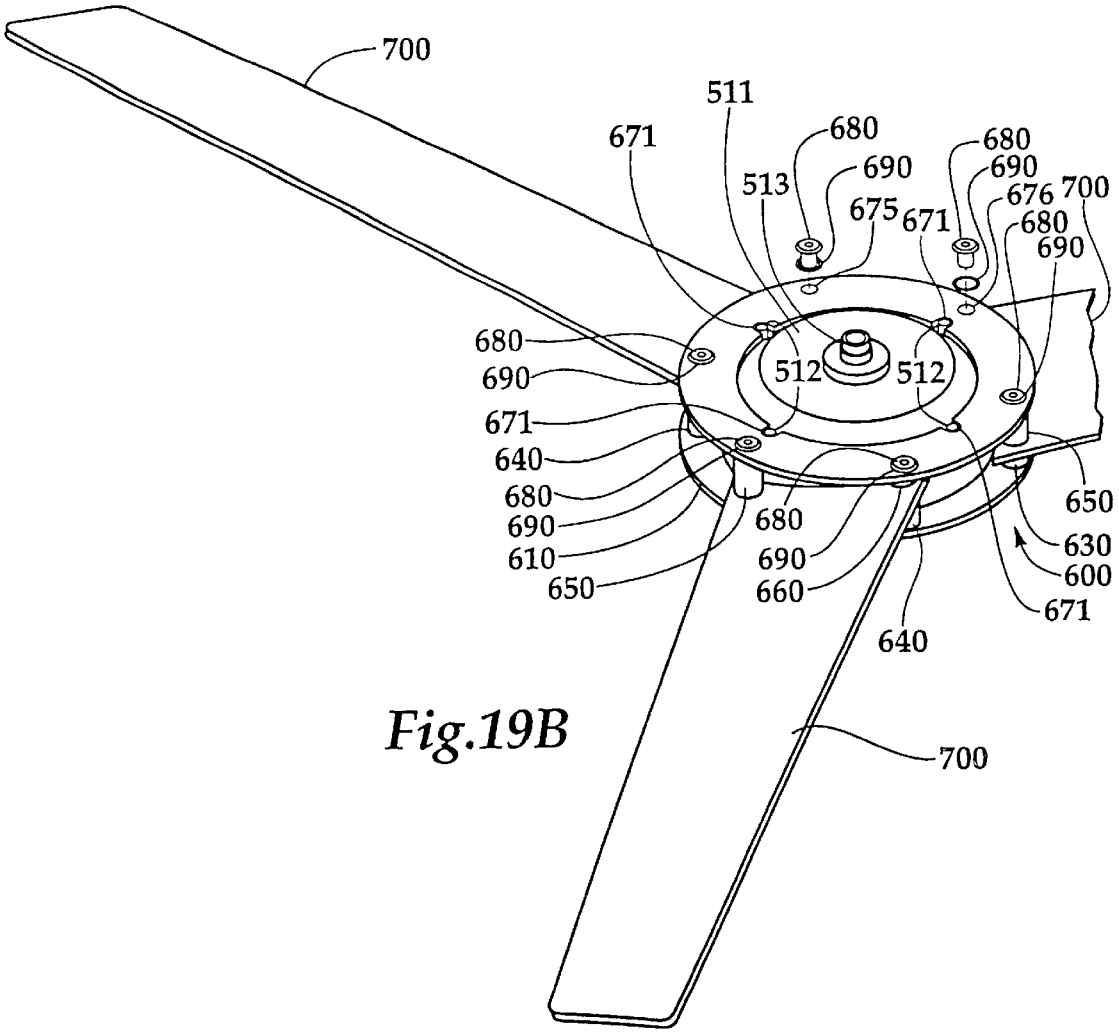
Figure 20A:
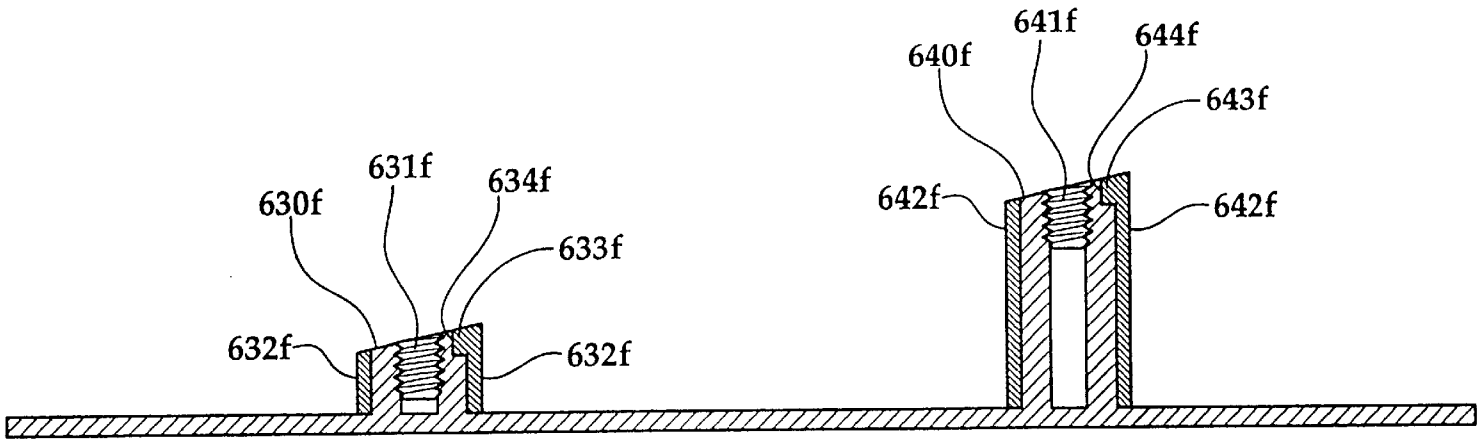
FIGS. 20A and 20B show a fragmentary partially cross-sectioned side view and a fragmentary top view illustrating an another embodiment of the lower housing bracket, the forward lower spacers, and the aft lower spacers from FIG. 17.
Figure 20B:
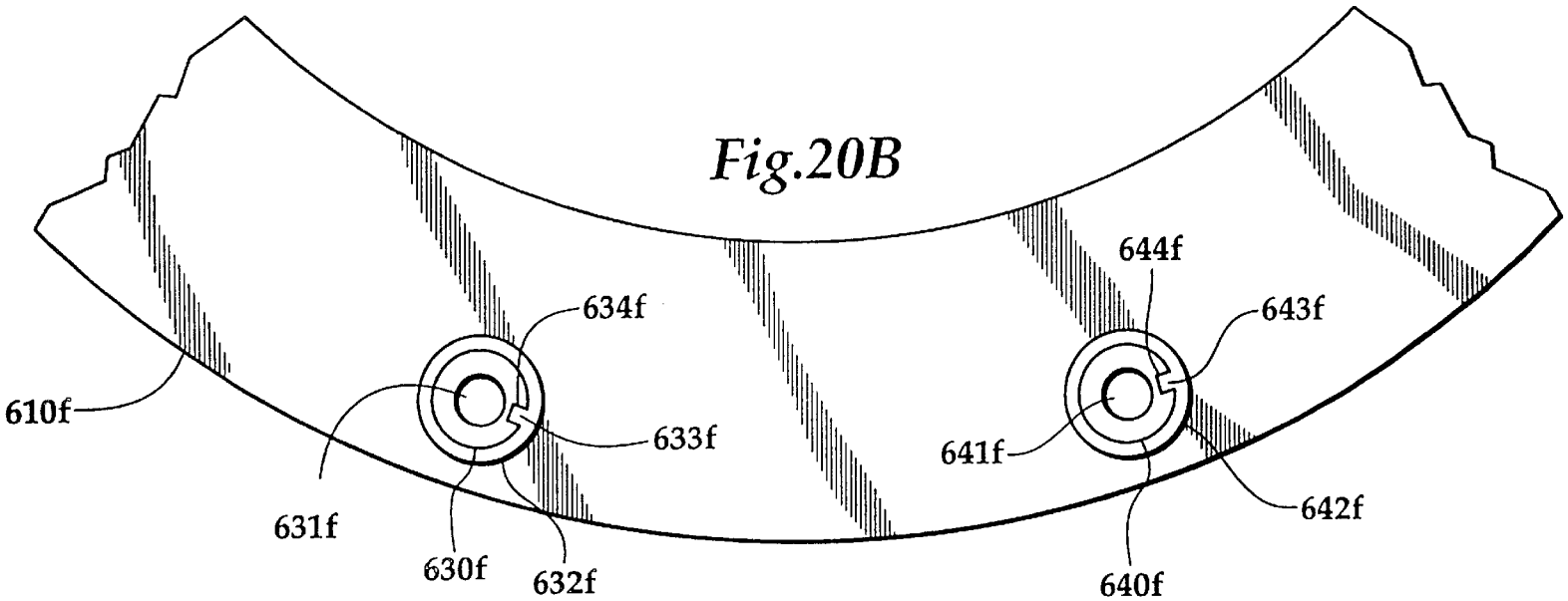
Figure 22:
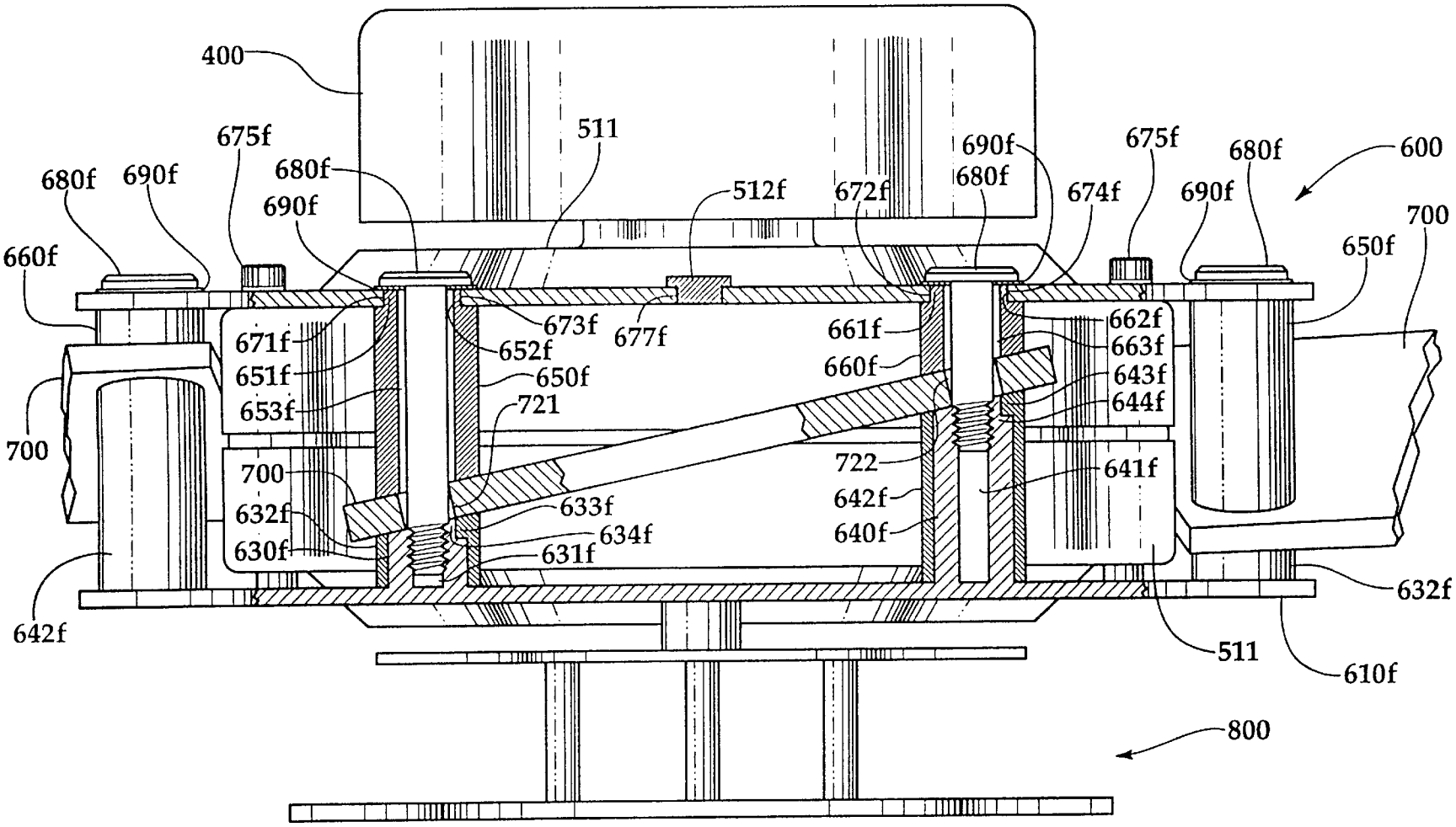
FIG. 22 shows a side fragmentary partial cross-sectional view of the motor housing from FIG. 17, using the lower motor housing bracket, forward lower spacer, aft lower spacer, forward upper spacer, aft upper spacer, and upper motor housing from FIGS. 20A–B and 21A–B.

Referring now to FIGS. 20A, 20B, and 22 there is shown another embodiment of the lower housing bracket 610, the forward lower spacers 630, and the aft lower spacers 640 in FIG. 17, illustrated as a lower housing bracket 610*f*, a forward lower spacers 630*f*, and the aft lower spacers 640*f*. A forward lower spacer threaded aperture 631*f* and an aft lower spacer threaded aperture 641*f* are used in place of the forward lower spacer stud 631 and the aft lower spacer stud 641 in FIG. 17. A forward lower spacer sleeve 632*f* and an aft lower spacer sleeve 642*f* fit over the forward lower spacer 630*f* and the aft lower spacer 640*f*, respectively. A forward lower sleeve key 633*f* in the forward lower spacer sleeve 632*f* fits into a forward lower spacer keyway 634*f* in the forward lower spacer 630*f*. Similarly, an aft lower sleeve key 643*f* in the aft lower spacer sleeve 642*f* fits into an aft lower spacer keyway 644*f* in the aft lower spacer 640*f*.

Figure 21A:
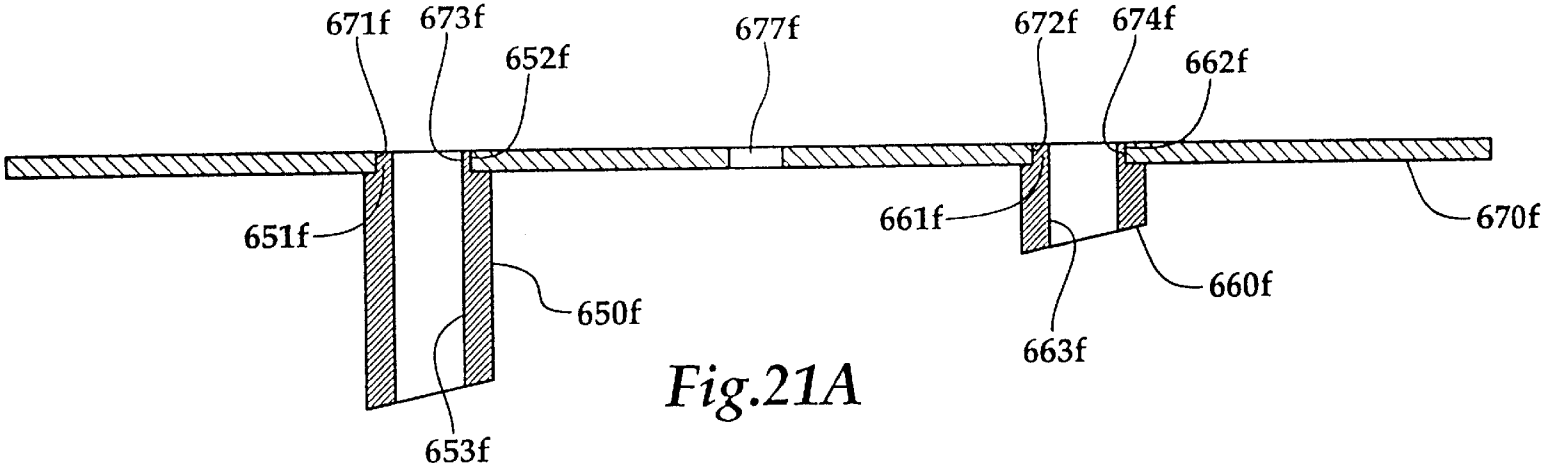
FIGS. 21A and 21B show a fragmentary partially cross-sectioned side view and a fragmentary top view illustrating an another embodiment of the upper housing bracket, the forward upper spacers, and the aft upper spacers from FIG. 17.
Figure 21B:
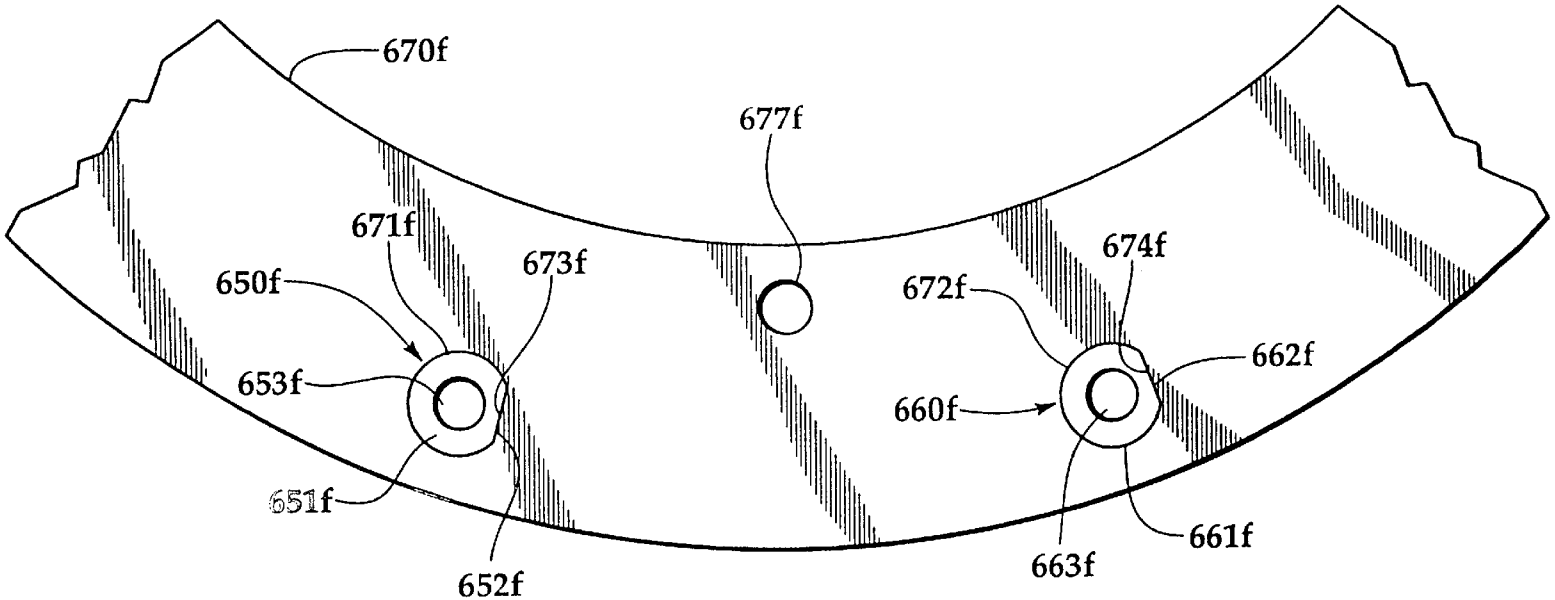

Referring now to FIGS. 21A, 21B, and 22 there is shown another embodiment of the upper housing bracket 670, the forward upper spacer 650, and the aft upper spacer 660 in FIG. 17, illustrated as an upper housing bracket 670*f*, a forward upper spacer 650*f*, and an aft upper spacer 660*f*. The upper housing bracket 670*f* has upper housing bracket forward spacer apertures 671*f* and upper housing bracket aft spacer apertures 672*f*. The upper housing bracket forward spacer apertures 671*f* have upper bracket forward upper spacer keyways or walls 673*f*, and the upper housing bracket aft spacer apertures 672*f* have upper bracket forward upper spacer keyways or walls 674*f*. The forward upper spacer 650*f* has a forward upper spacer top protrusion 651*f* that fits within the upper bracket forward upper spacer apertures 671*f*, with a forward upper spacer key or straight section 652*f* that matches the upper bracket forward upper spacer keyways 673*f*. The aft upper spacer 660*f* has an aft upper spacer top protrusion 661*f* that fits within the upper bracket aft upper spacer apertures 672*f*, with a forward upper spacer key or straight section 662*f* that matches the upper bracket forward upper spacer keyways 674*f*. The forward upper spacer 650*f* includes a forward upper spacer bore 653*f*, and the aft upper spacer 650*f* includes aft upper spacer bore 663*f*. The upper housing bracket 670*f* also includes a plurality of upper housing bracket mounting apertures 677*f*.

Referring now to FIG. 22, there is shown a side fragmentary partial cross-sectional view of the motor housing 600 from FIG. 17, using the lower motor housing bracket 610*f*, forward lower spacer 630*f*, aft lower spacer 640*f*, forward upper spacer 650*f*, aft upper spacer 660*f*, and upper motor housing 670*f* from FIGS. 20A–B and 21A–B. Motor housing bolts 680*f* pass through motor housing lock washers 690*f*, the forward upper spacer bore 653*f*, and the forward blade mount apertures 721, and engage the forward lower spacer threaded aperture 631*f*. Motor housing bolts 680*f* also pass through the motor housing lock washers 690*f*, the aft upper spacer bore 663*f*, and the aft blade mount apertures 722, and engage the aft lower spacer threaded aperture 641*f*.

In this manner, the blades 700 are secured between the forward lower spacers 630*f* and the forward upper spacers 650*f*, and between the aft lower spacers 640*f* and the aft upper spacers 660*f*. The motor housing bolts also secure the upper housing bracket 670*f* to the lower motor housing bracket 610*f*. Motor housing mounting screws 512*f* pass through the upper housing mounting apertures 677*f* in the upper motor housing 670*f* and engage threaded apertures in the motor body 511 to secure the motor housing assembly 600 to the motor body 511. In another embodiment, the motor housing assembly 600 is secured to the motor body 511 by the motor housing bolts 680*f* causing the upper motor housing 670*f* and the lower motor housing 610*f* to apply pressure to the motor housing 511 therebetween.

Figure 23:
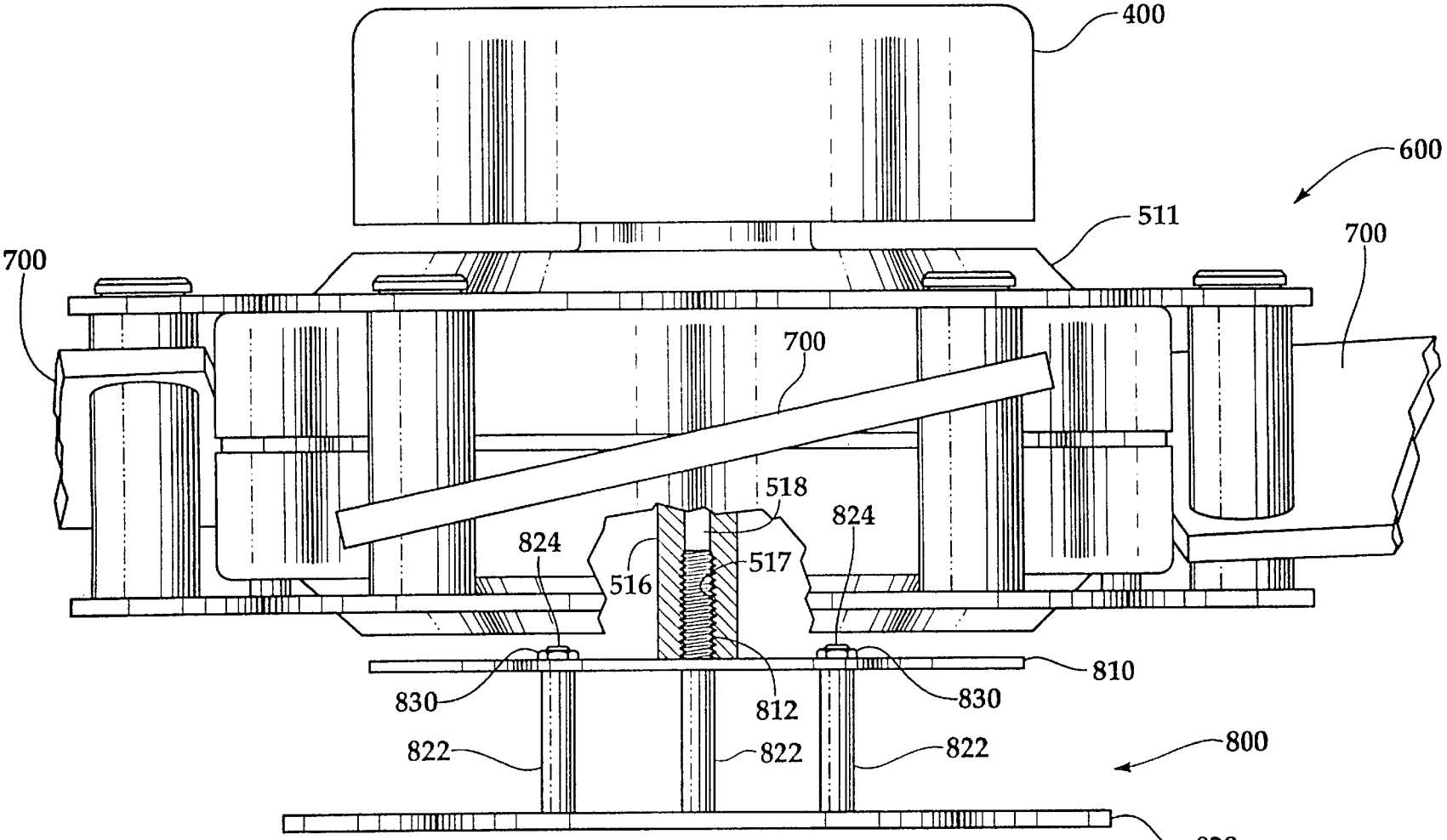
FIG. 23 shows the lower canopy, motor assembly, motor housing assembly, blades, and lower platter from FIG. 1, with a fragmentary partially cross-sectioned view of the motor assembly, motor housing assembly, and platter assembly to illustrate the assembly and securement of the platter assembly.
Figure 24:
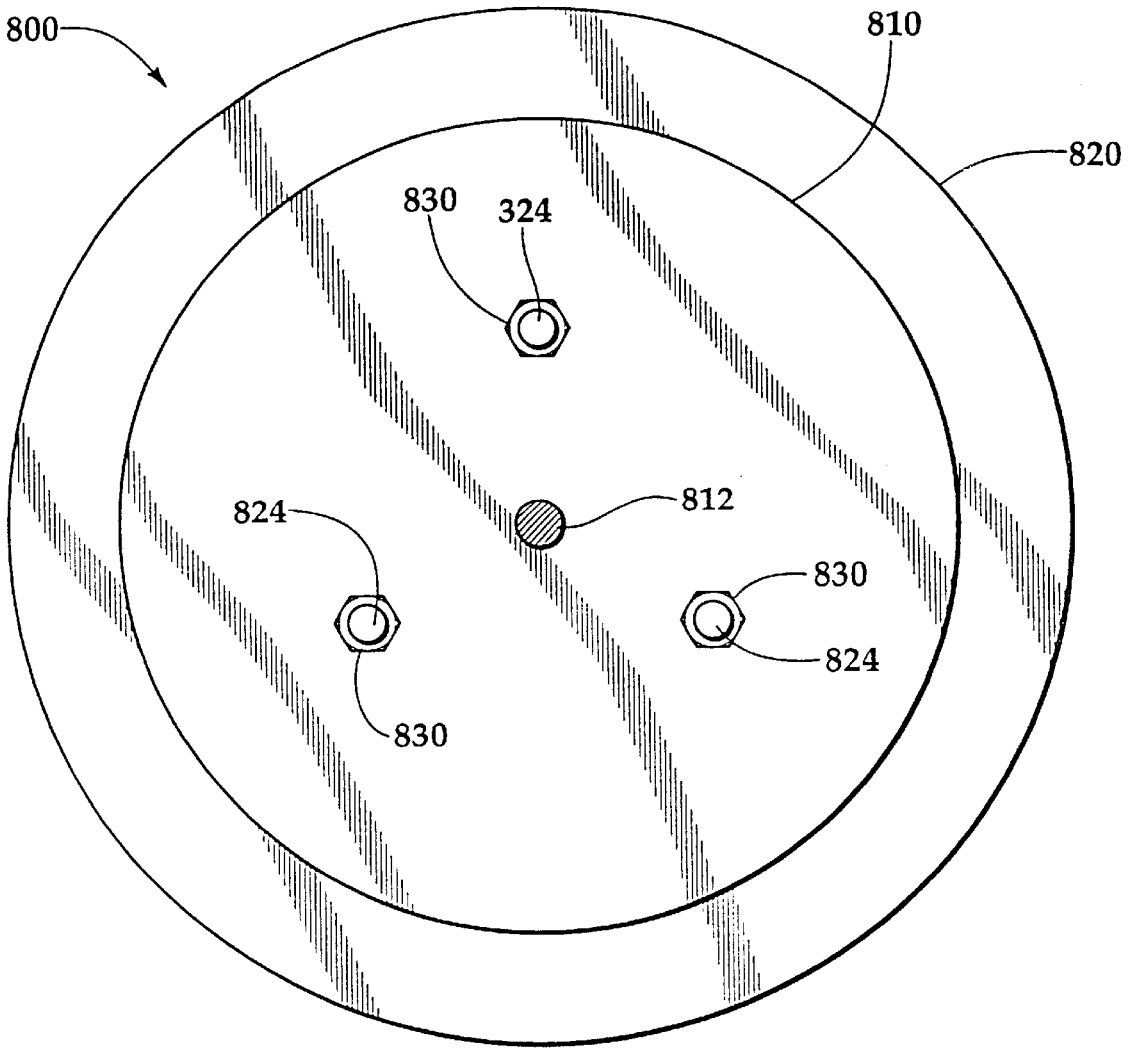
FIG. 24 shows a top view of the platter assembly from FIG. 23.

Referring now to FIGS. 23 and 24, the hub or platter assembly 800 includes an upper platter plate 810 secured to the motor shaft lower portion 516, and a lower platter plate 820 secured to the upper platter plate 810. The motor shaft lower portion 516 is made suitably short to allow close proximity (e.g. approximately ⅛ to ⅜ of an inch) of the upper platter plate 810 to the motor 510 or motor body 511. The upper platter plate 810 is secured to the motor shaft lower portion 516 by an upper platter plate mounting stud 812 of the upper platter plate 810 that engages the internal motor threads 517 in the motor shaft lower portion 516. In one preferred embodiment, a thread locking compound is used on the internal motor threads 517 and the upper platter plate mounting stud 812 to prevent relative movement of the two components. In another embodiment, the motor shaft lower portion 516 has external threads in place of the internal motor threads 517, and an internal threaded bore in the upper platter plate 810 in place of the stud 812 engages the external threads on the motor shaft lower portion 516. The lower platter plate 820 includes lower platter plate spacers 822 with lower platter plate mounting studs 824. The lower platter plate mounting studs 822 pass through lower plate mounting apertures 814 in the upper platter plate 810 and engage lower platter late mounting nuts 830, thereby securing the lower platter plate 820 to the upper platter plate 810.

Figure 25:
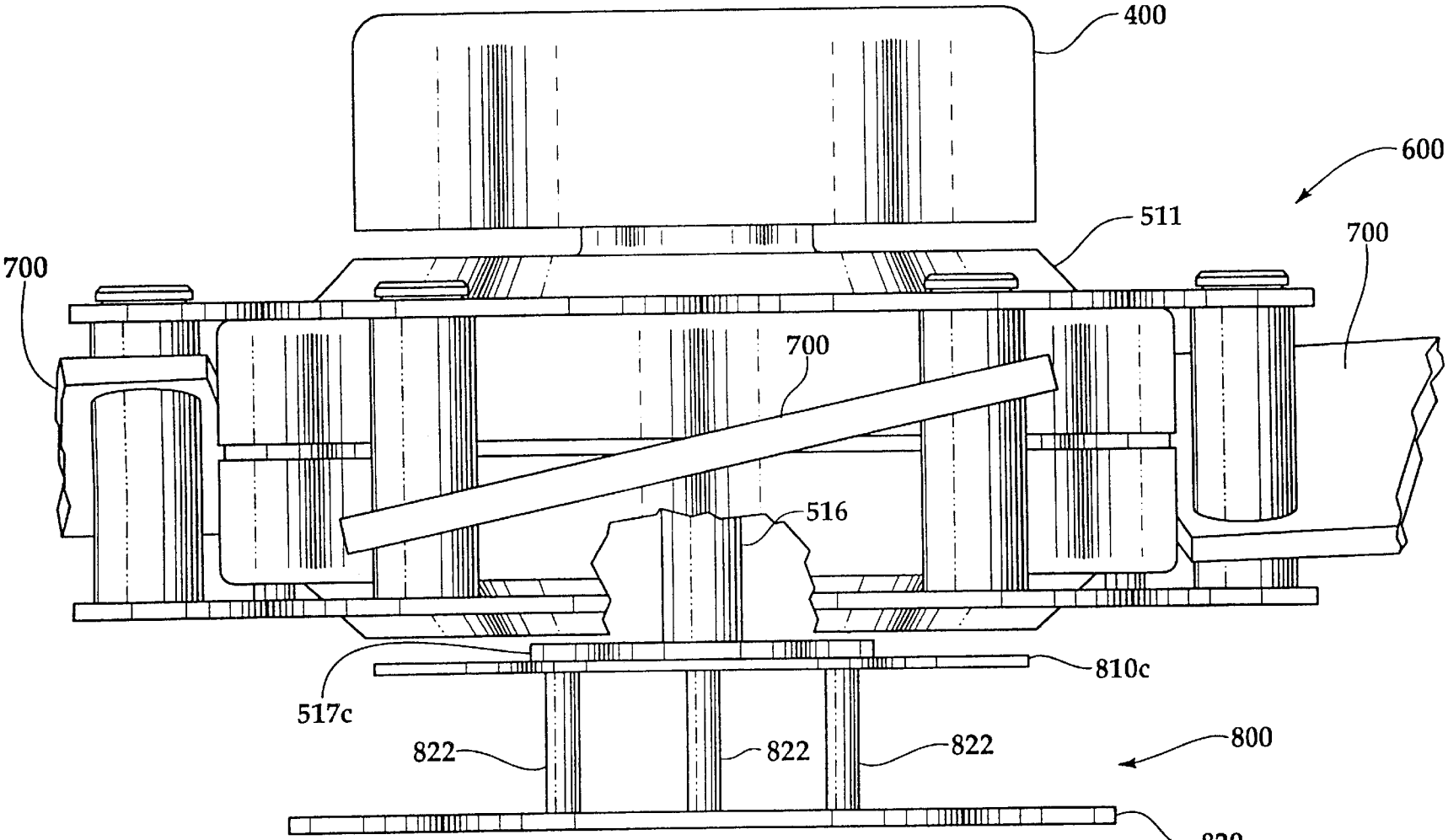
FIG. 25 illustrates an alternate embodiment of the platter assembly in FIG. 23, showing the motor assembly, motor housing assembly, and alternate platter assembly partially cross-sectioned to illustrate the alternative platter assembly.

Referring now to FIG. 25, there is shown another embodiment of securing the hub or platter assembly 800 in FIGS. 23 and 24, illustrated using an upper platter plate 810*c* in place of the upper platter plate 810. To mount the upper platter plate 810*c*, the motor shaft lower portion 516 has a platter mounting plate 517*c* in place of the internal threads 517. The upper platter plate 810*c* is attached to the mounting plate 517*c* by screws, rivets, mechanical fasteners, adhesives, or any commonly known methods of attaching two parts. The lower platter plate spacers 822 of the lower platter plate 820 are secured to the upper platter plate 810*c* in the same fashion as the lower platter spacers 822 are secured to the upper platter plate 810 in FIGS. 18 and 19.

Figure 26:
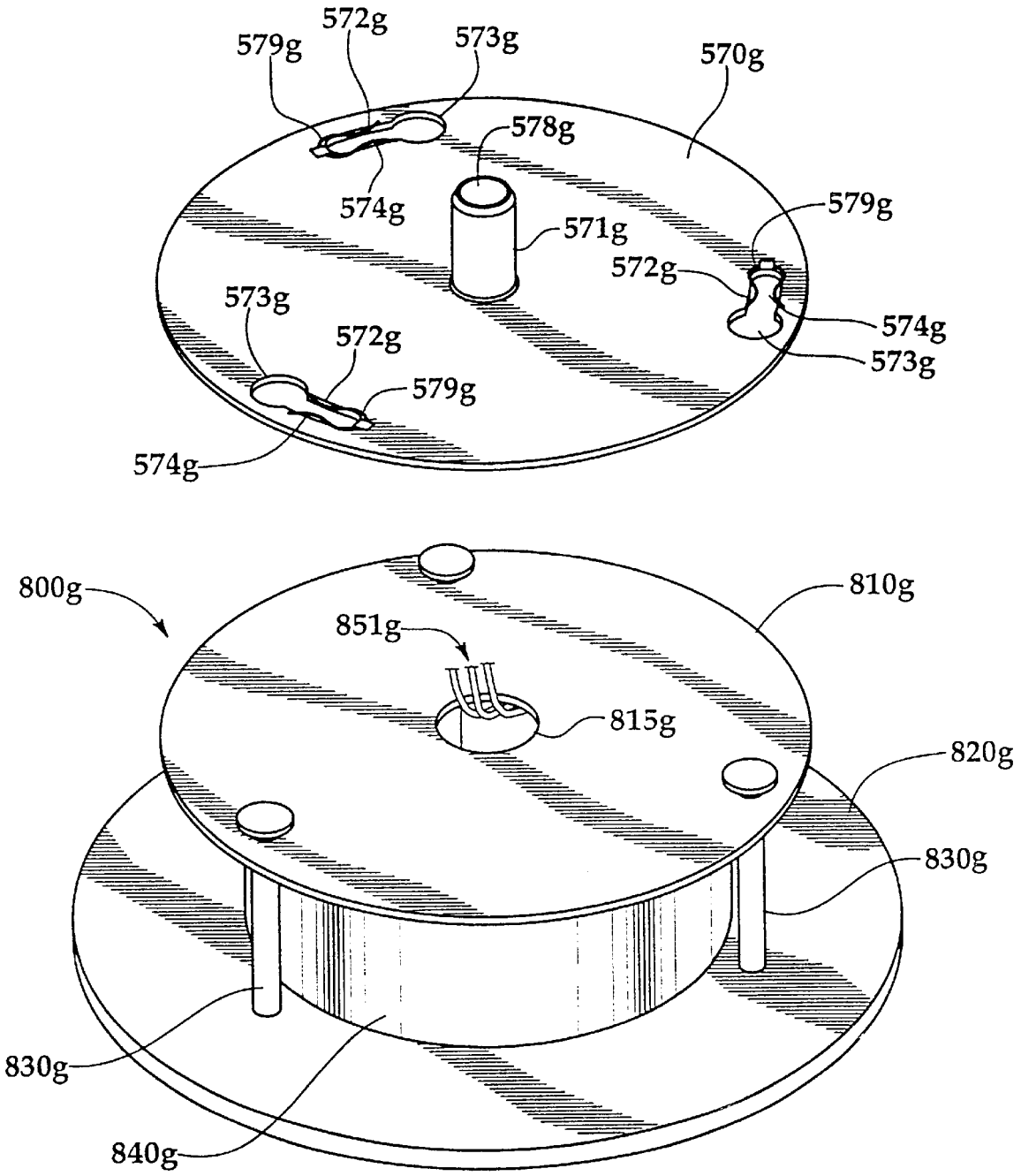
FIG. 26 shows an exploded view of an alternative embodiment of the pattern assembly in FIG. 23 illustrated as a platter/lighting assembly and a means for attaching the platter lighting assembly to the motor shaft.
Figure 27:
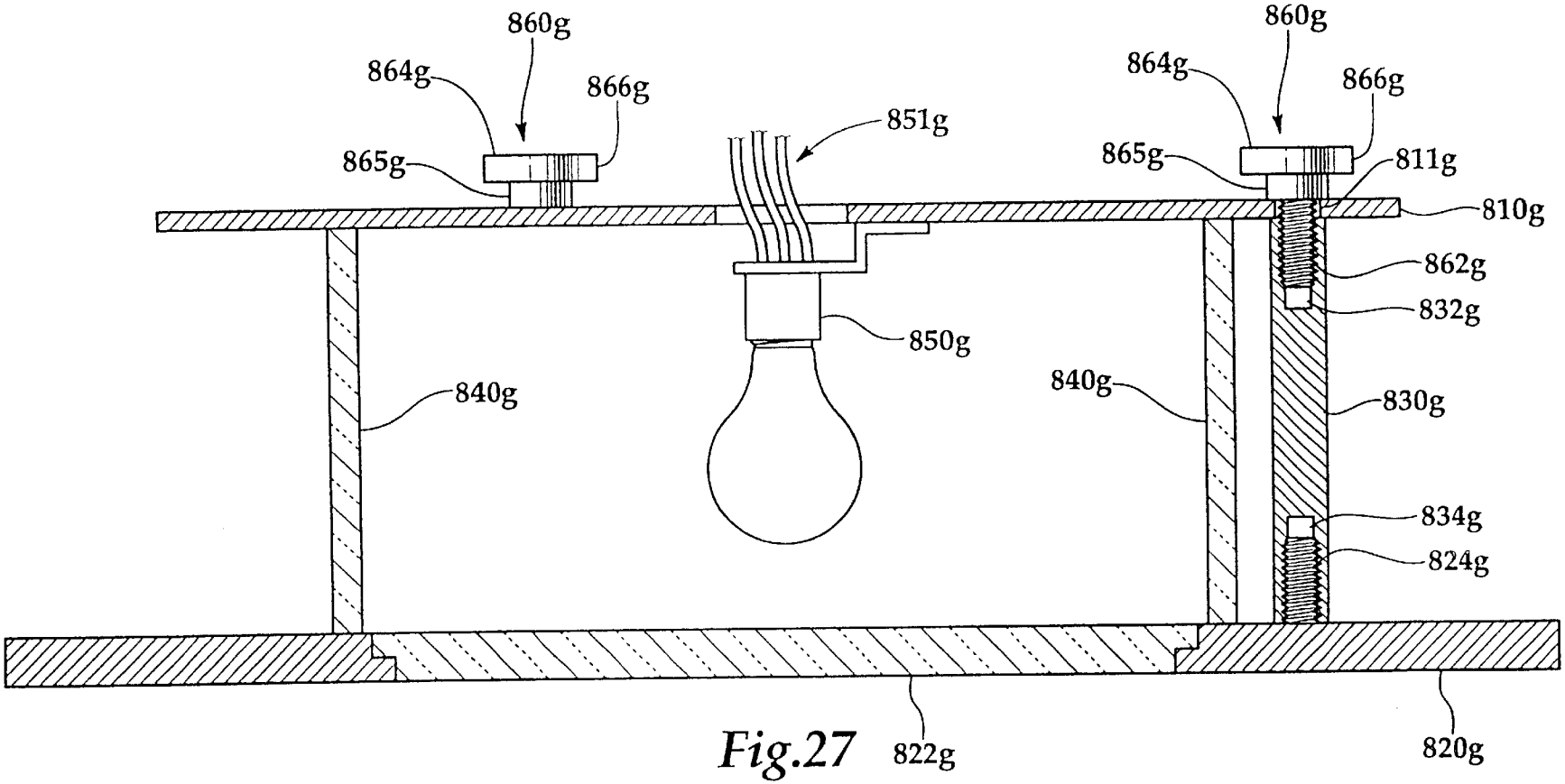
FIG. 27 shows partial cross-sectional view the patter/lighting assembly in FIG. 26.

Referring now to FIGS. 26 and 27, there is shown another embodiment of the hub or platter assembly 800 in FIG. 23 illustrated as the hub or platter/lighting assembly 800*g*, which is mounted using the platter mounting plate 570*g*. The platter/lighting assembly 800*g* generally includes an upper platter plate 810*g*, a lower platter plate 820*g*, platter assembly spacers 830*g*, a lighting globe 840*g*, and a lighting fixture 850*g*. The lower platter plate 820*g* includes lower platter plate mounting studs 824*g* that engage lower platter spacer threaded apertures 834*g*, and a transparent or translucent lower platter center 822*g*. The lighting globe 840*g* is disposed between the upper platter plate 810*g* and the lower platter plate 820*g*. The upper platter plate 810*g* includes a central wiring aperture 815*g* and upper platter spacer mounting apertures 811*g*. The lighting fixture 850*g* is disposed below the upper platter plate 810*g* within the lighting globe 840*g*, and the lighting electrical wires 851*g* for the lighting fixture 850*g* pass through the central wiring aperture 815*g* in the upper platter plate 810*g*. Upper platter mounting screw/studs 860*g* have a threaded fastener portion 862*g* disposed below a mounting stud section 864*g*. The threaded fastener portion 862*g* of the upper platter mounting screw/studs 860*g* secure the upper platter plate 810*g* to the platter spacers 830*g* by passing through the upper platter spacer mounting apertures 811*g* and engaging upper platter spacer threaded apertures 832*g*.

Referring still to FIGS. 26 and 27, the platter mounting plate 570*g* has a platter mounting plate shaft 571*g* extending upwardly therefrom for engagement with the central motor shaft passage 518 in the motor shaft 513. The platter mounting plate shaft 571*g* secures to the motor shaft 513 by friction, threaded engagement, welding, adhesives, mechanical fasteners or the like. The platter mounting plate also has platter mounting slots 572*g* that have a larger initial opening 573*g* and a smaller sliding opening 574*g* that extend in the same circumferential direction. The mounting stud section 864*g* of the upper platter mounting screws/studs 860*g* include stud inner shaft portion 865*g* that is smaller than the smaller sliding opening 574*g* in the platter mounting plate 570*g* and a stud outer head portion 866*g* that is smaller than the larger initial opening 873*g* in the platter mounting plate 870*g* but is larger than the smaller sliding opening 574*g*.

Still referring to FIGS. 26 and 27, the platter/lighting assembly 800*g* is mounted on the platter mounting plate 570*g* by extending the mounting stud sections 864*g* of the upper platter mounting screws/studs 860*g* into the larger initial opening 573*g* of the platter mounting slots 572*g* of the platter mounting plate 570*g*, and turning the platter/lighting assembly 800*g* until the inner shaft portion 865*g* of the upper platter mounting screws/studs 860*g* are disposed within the smaller sliding opening 574*g* of the platter mounting slots 572*g*, and the stud outer head portion 866*g* of the upper platter mounting screws/studs 860*g* rest on the platter mounting plates 570*g*. Also, a mounting plate central passage 578*g* allows the lighting electrical wires 851*g* to connect with electrical wires 910 from the central motor shaft passage 518 in the motor shaft 513.

Referring still to FIGS. 26 and 27, in the installed position for the platter/lighting assembly 800*g*, platter securement devices 579*g*, illustrated in FIG. 27 as a spring clip, prevent the upper platter mounting screw/studs 860*g* from rotating to disengage with the upper platter mounting plate 570*g*. Although the platter securement devices 579*g* are illustrated in FIG. 27 as a spring clip, other securement devices may be used in its place such as forming the smaller sliding opening 574*g* with a narrow portion near the larger initial opening 573*g* such that the narrow opening applies resistance to the movement of inner shaft portion 865*g* between the smaller sliding opening 574*g* and the larger initial opening 573*g*. In another embodiment, the platter mounting plate 570*g* is formed with small protrusions that the stud outer head portion 866*g* must pass over when progressing from the larger initial opening 573*g* of the platter mounting slots 572*g* to the smaller sliding opening 574*g*. In yet another embodiment, the platter mounting plate 570*g* is formed with the smaller sliding opening 574*g* of the platter mounting slots 572*g* being disposed in a lower position than the larger initial opening 573*g*.

In one method of assembling the present invention, a motor assembly 500 is provided with the lower housing bracket 610. The motor assembly includes the motor 510 with the motor body 511 and the motor shaft 513 with the motor lower shaft portion 516 and the motor upper shaft portion 514 having the motor mounting nut 530 thereon. The lower housing bracket 610 that is provided includes the forward lower spacers 630, with their associated forward lower spacer studs 631, and the aft lower spacers 640 with their associated aft lower spacers studs 641. The pairs of forward lower spacers 630 and aft lower spacers 640 are provided for a predetermined plurality of blades 700.

The blades 700 corresponding to the pairs of forward lower spacers 630 and aft lower spacers 640 are provided with forward blade mounting apertures 721 and aft blade mounting apertures 722 that correspond to the forward lower spacers 630 and the aft lower spacers 640, respectively. The blades 700 are positioned with the forward blade mount apertures and the aft blade mount apertures around the corresponding forward lower spacer studs 631 and the aft lower spacer studs 642.

The upper housing bracket 670 is provided with forward upper spacers 650 and aft upper spacers 660 corresponding to the forward lower spacers 630 and the aft lower spacers 640. The upper housing bracket 670 provided includes forward stud apertures 675 that pass through the forward upper spacers 650 and aft stud apertures 676 that pass through the aft upper spacers 660. The upper housing bracket is positioned with the forward lower spacer studs 631 in the forward stud apertures 675, and the aft lower spacer studs 641 in the aft stud apertures. In this position, the forward lower spacer 630, aft lower spacer 640, forward upper spacer 650 and aft upper spacer 660 are flat to the blades 700.

The motor housing nuts 680 with the motor housing lock washers 690 are screwed onto the forward lower spacer stud 631 and the aft lower spacer stud 641 through the forward stud apertures 675 and the aft stud apertures 676. In this position, the motor housing nuts are tightened to secure the lower housing bracket 610 to the upper housing bracket 670, and the blades 700 between the forward lower spacer 630 and the forward upper spacer 650, and between the aft lower spacer 640 and the aft upper spacer 660.

The downrod assembly 200 is provided with the downrods 220 secured between the upper downrod brackets 210 and the lower downrod bracket 250. The downrod assembly 200 also has electrical wires 910 which exit at the upper and lower end of the downrod assembly 200. The electrical wires 910 at the lower end of the downrod assembly 200 are connected to electrical wires extending from the motor assembly 500. The lower portion of the downrod assembly 200 is secured to the motor assembly 500 by extending the mounting nut downrod assembly fasteners 540 through the lower bracket mounting apertures 253 in the lower downrod bracket 250, and tightening the mounting nut downrod fasteners 540 into the threaded downrod assembly mounting bores 532 in the motor mounting nut 530 of the motor assembly 500.

The ceiling bracket assembly 100 is either attached directly to the ceiling or an electrical outlet box 1 in the ceiling. To attach the ceiling bracket 100 to the electrical outlet box 1, outlet mounting screws to extend through ceiling bracket mounting slots 112 in a ceiling bracket mounting plate 111, and are secured to the electrical outlet box by outlet box mounting nuts 4.

The upper downrod bracket 210 is extended from the ceiling bracket assembly 100 by a ceiling pivot bolt 130 that passes through the ceiling pivot bushings 120 in the ceiling bracket assembly 100 and upper downrod bracket pivot apertures 214 in upper downrod bracket pivot arms 213 of the upper downrod bracket 210. A ceiling pivot nut 140 is secured on the ceiling pivot bolt 130 to ensure that the ceiling pivot bolt 130 keeps the downrod assembly 200 secured to the ceiling bracket assembly 100.

The electrical wires 910 are then attached to electrical wires from the ceiling for controlling the ceiling fan. After the electrical wires 910 are connected, the upper canopy 310 is secured to the ceiling bracket 100 by upper canopy mounting screws 320 that pass through upper canopy screw apertures 312 in the upper canopy 310 and engage ceiling bracket canopy mounting apertures 116 in ceiling bracket canopy mounting flanges 115 of the ceiling bracket 110. The ceiling cover 330 is secured to the upper canopy 310 by exposing the adhesive tape 340 and pressing the ceiling cover 330 and adhesive tape 340 against the upper canopy 310.

The lower platter assembly 800 is then provided for securement to the motor assembly 500, the motor platter assembly having a lower platter plate 820 with lower platter plate spacers 822 that are secured to the upper platter plate 810. In the case where the motor shaft lower portion 516 has internal motor threads 517, the upper platter plate 810 has an upper platter plate mounting stud 812 that is screwed into the internal motor threads 517. In the case where the motor shaft lower portion 516 has a platter mounting plat 517*c* in place of the internal motor threads 517, the upper platter plate 810*c* is secured directly to the mounting plate 517*c*.

In one method of assembling the present invention, a motor assembly 500 is provided with the lower housing bracket 610. The motor assembly includes the motor 510 with the motor body 511 and the motor shaft 513 with the motor lower shaft portion 516 and the motor upper shaft portion 514 having the motor mounting nut 530 thereon. The lower housing bracket 610 that is provided includes the forward lower spacers 630, with their associated forward lower spacer studs 631, and the aft lower spacers 640 with their associated aft lower spacers studs 641. The pairs of forward lower spacers 630 and aft lower spacers 640 are provided for a predetermined plurality of blades 700.

The blades 700 corresponding to the pairs of forward lower spacers 630 and aft lower spacers 640 are provided with forward blade mounting apertures 721 and aft blade mounting apertures 722 that correspond to the forward lower spacers 630 and the aft lower spacers 640, respectively. The blades 700 are positioned with the forward blade mount apertures and the aft blade mount apertures around the corresponding forward lower spacer studs 631 and the aft lower spacer studs 642.

The upper housing bracket 670 is provided with forward upper spacers 650 and aft upper spacers 660 corresponding to the forward lower spacers 630 and the aft lower spacers 640. The upper housing bracket 670 provided includes forward stud apertures 675 that pass through the forward upper spacers 650 and aft stud apertures 676 that pass through the aft upper spacers 660. The upper housing bracket is positioned with the forward lower spacer studs 631 in the forward stud apertures 675, and the aft lower spacer studs 641 in the aft stud apertures. In this position, the forward lower spacer 630, aft lower spacer 640, forward upper spacer 650 and aft upper spacer 660 are flat to the blades 700.

The motor housing nuts 680 with the motor housing lock washers 690 are screwed onto the forward lower spacer stud 631 and the aft lower spacer stud 641 through the forward stud apertures 675 and, the aft stud apertures 676. In this position, the motor housing nuts are tightened to secure the lower housing bracket 610 to the upper housing bracket 670, and the blades 700 between the forward lower spacer 630 and the forward upper spacer 650, and between the aft lower spacer 640 and the aft upper spacer 660.

The downrod assembly 200 is provided with the downrods 220 secured between the upper downrod brackets 210 and the lower downrod bracket 250. The downrod assembly 200 also has electrical wires 910 which exit at the upper and lower end of the downrod assembly 200. The electrical wires 910 at the lower end of the downrod assembly 200 are connected to electrical wires extending from the motor assembly 500. The lower portion of the downrod assembly 200 is secured to the motor assembly 500 by extending the mounting nut downrod assembly fasteners 540 through the lower bracket mounting apertures 253 in the lower downrod bracket 250, and tightening the mounting nut downrod fasteners 540 into the threaded downrod assembly mounting bores 532 in the motor mounting nut 530 of the motor assembly 500.

The ceiling bracket assembly 100 is either attached directly to the ceiling or an electrical outlet box 1 in the ceiling. To attach the ceiling bracket 100 to the electrical outlet box 1, outlet mounting screws to extend through ceiling bracket mounting slots 112 in a ceiling bracket mounting plate 111, and are secured to the electrical outlet box by outlet box mounting nuts 4.

The upper downrod bracket 210 is extended from the ceiling bracket assembly 100 by a ceiling pivot bolt 130 that passes through the ceiling pivot bushings 120 in the ceiling bracket assembly 100 and upper downrod bracket pivot apertures 214 in upper downrod bracket pivot arms 213 of the upper downrod bracket 210. A ceiling pivot nut 140 is secured on the ceiling pivot bolt 130 to ensure that the ceiling pivot bolt 130 keeps the downrod assembly 200 secured to the ceiling bracket assembly 100.

The electrical wires 910 are then attached to electrical wires from the ceiling for controlling the ceiling fan. After the electrical wires 910 are connected, the upper canopy 310 is secured to the ceiling bracket 100 by upper canopy mounting screws 320 that pass through upper canopy screw apertures 312 in the upper canopy 310 and engage ceiling bracket canopy mounting apertures 116 in ceiling bracket canopy mounting flanges 115 of the ceiling bracket 110. The ceiling cover 330 is secured to the upper canopy 310 by exposing the adhesive tape 340 and pressing the ceiling cover 330 and adhesive tape 340 against the upper canopy 310.

The lower platter assembly 800 is then provided for securement to the motor assembly 500, the motor platter assembly having a lower platter plate 820 with lower platter plate spacers 822 that are secured to the upper platter plate 810. In the case where the motor shaft lower portion 516 has internal motor threads 517, the upper platter plate 810 has an upper platter plate mounting stud 812 that is screwed into the internal motor threads 517. In the case where the motor shaft lower portion 516 has a platter mounting plat 517*c* in place of the internal motor threads 517, the upper platter plate 810*c* is secured directly to the mounting plate 517*c*.

It is thus believed that the operation and construction of the present invention will be apparent from the foregoing description of a preferred embodiment. While the device and method shown are described as being preferred, it will be obvious to a person of ordinary skill in the art that various changes and modifications may be made therein without departing from the spirit and scope of the invention as defined in the following claims. Therefore, the spirit and scope of the appended claims should not be limited to the description of the preferred embodiments contained herein.

What is claimed is:

1. A blade mounting assembly for a ceiling fan having a plurality of blades and a ceiling fan motor with a motor body that rotates about a motor shaft, the blade mounting assembly comprising:

a first ring secured to said motor body;

a plurality of sets of first spacers disposed on the first ring, each of the sets of first spacers corresponding to a different one of said plurality of blades;

a second ring having a plurality of sets of second spacers disposed therein, each of the sets of second spacers corresponding to a different one of said plurality of blades;

wherein the second ring is secured to the first ring such that each of said plurality of blades are disposed between the corresponding set of first spacers and the corresponding set of second spacers; and wherein the plurality of sets of first spacers each comprise a shorter first spacer and a longer first spacer; wherein the plurality of sets of second spacers each comprise a longer second spacer and a shorter second spacer; and wherein each of the blades are disposed between the corresponding shorter first spacer and longer second spacer, and between the corresponding longer first spacer and the shorter second spacer.

2. The blade mounting assembly according to claim 1, wherein said first ring is secured to motor body by a fastener.

3. The blade mounting assembly according to claim 1, wherein said first ring is secured to said motor body by an adhesive member.

4. The blade mounting assembly according to claim 1, wherein said motor body includes a first ring mounting surface, an opposing second ring mounting surface, and a motor key on said first ring mounting surface; wherein said first ring includes a motor keyway for engaging said motor key; and wherein said first ring is secured to said second ring with said first ring engaging the first ring surface of said motor body, said second ring engaging said second ring surface of said motor body, and said motor keyway of said first ring engaging the motor key, thereby securing said first ring to said motor body.

5. The blade mounting assembly according to claim 1, wherein said first spacers are integral part of the first ring.

6. The blade mounting assembly according to claim 1, wherein said first ring has a plurality of first ring apertures, each first ring aperture corresponding to a particular one of said first spacers; wherein each one of said first spacers includes a first spacer bore therethrough; wherein each one of said second spacers have a threaded second spacer aperture; and further including a plurality of threaded members, each one of said threaded members corresponding to a particular one of said first ring apertures, first spacers, and second spacers; wherein said threaded member passes through the corresponding first ring aperture and first spacer bore and engages the corresponding threaded second spacer aperture, thereby securing said first ring to said second ring.

7. The blade mounting assembly according to claim 6, further including a plurality of second spacer sleeves, each one of said second spacer sleeves for covering a particular one of said plurality of second spacers.

8. The blade mounting assembly according to claim 7, wherein said second spacers include second spacer keyways, and said second spacer sleeves each include a second spacer sleeve key engaging the second spacer keyway of the corresponding second spacer.

9. The blade mounting assembly according to claim 6, wherein each blade includes a set of blade apertures, each one of said blade apertures being associated with one of first spacers and second spacers corresponding to the particular blade, and wherein each one of said threaded members passes through the blade aperture associated with the first spacer and the second spacer corresponding to the threaded member.

10. The blade mounting assembly according to claim 1, wherein said first ring includes a plurality of first ring apertures, each one of said first ring apertures corresponding to a particular one of said first spacers; wherein each one of said first spacers includes a first spacer bore therethrough; wherein each one of said second spacers includes a threaded extension extending away from said second ring; and further including a plurality of threaded members for passing through an associate one of said first ring apertures and first spacer bores and engaging the threaded extension of an associated one of said second spacers, thereby securing said first ring to said second ring.

11. The blade mounting assembly according to claim 10, wherein said blade includes a set of blade apertures, each of said blade apertures are associated with one of the first spacers and second spacers corresponding to the particular blade; and wherein the threaded extensions of the second spacers corresponding to each of said blades pass through the associated blade aperture.

12. The blade mounting assembly according to claim 1, wherein said second ring includes a plurality of second ring apertures, each one of said second ring apertures corresponding to a particular one of said second spacers; wherein each one of said second spacers includes a second spacer bore therethrough; wherein each one of said first spacers includes a threaded extension extending away from said first ring; and further including a plurality of threaded members for passing through an associate one of said second ring apertures and second spacer bores and engaging the threaded extension of an associated one of said first spacers, thereby securing said second ring to said first ring.

13. The blade mounting assembly according to claim 12, wherein said blade includes a set of blade apertures, each of said blade apertures are associated with one of the second spacers and first spacers corresponding to the particular blade; and wherein the threaded extensions of the first spacers corresponding to each of said blades pass through the associated blade aperture.

* * * * *

UNITED STATES PATENT AND TRADEMARK OFFICE

CERTIFICATE OF CORRECTION

PATENT NO. : 6,250,885 B1
DATED : June 26, 2001
INVENTOR(S) : Mark Gajewski

It is certified that error appears in the above-identified patent and that said Letters Patent is hereby corrected as shown below:

Title page,
Item [56], delete the second occurrence of " Mark Gajewski, U.S. Application No. 09/047,257, filed Mar. 24, 1997.".

Column 2,
Line 1, insert -- invention -- after present.
Line 56, insert -- , and -- after downrods.

Column 3,
Line 1, insert -- a -- after shows.
Line 2, insert -- and -- after view.
Line 54, replace "pattern" with -- platter --.
Line 58, replace "patter/" with -- platter/ --.

Column 9,
Line 5, replace "and an or second ring 670" with -- and an upper housing bracket 670 or second ring --.

Column 10,
Line 18, replace both occurrences of "spacers" with -- spacer --.

Column 11,
Line 38, replace "late" with -- plate --.

Column 14,
Line 28, replace "plat" with -- plate --.

Column 15,
Line 59, replace "plat" with -- plate --.

Signed and Sealed this

Thirtieth Day of April, 2002

*Attest:*

*Attesting Officer*

JAMES E. ROGAN
*Director of the United States Patent and Trademark Office*